US009790762B2

(12) United States Patent
Tolman et al.

(10) Patent No.: US 9,790,762 B2
(45) Date of Patent: Oct. 17, 2017

(54) CORRODIBLE WELLBORE PLUGS AND SYSTEMS AND METHODS INCLUDING THE SAME

(71) Applicants: Randy C. Tolman, Spring, TX (US); Timothy J. Hall, Houston, TX (US)

(72) Inventors: Randy C. Tolman, Spring, TX (US); Timothy J. Hall, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 302 days.

(21) Appl. No.: 14/570,758

(22) Filed: Dec. 15, 2014

(65) Prior Publication Data

US 2015/0247376 A1 Sep. 3, 2015

Related U.S. Application Data

(60) Provisional application No. 61/946,590, filed on Feb. 28, 2014, provisional application No. 62/023,679, filed on Jul. 11, 2014.

(51) Int. Cl.
*E21B 29/00* (2006.01)
*E21B 33/129* (2006.01)
*E21B 33/12* (2006.01)

(52) U.S. Cl.
CPC ..... *E21B 33/12* (2013.01); *E21B 33/1208* (2013.01); *E21B 33/1293* (2013.01)

(58) Field of Classification Search
CPC ..... E21B 33/134; E21B 33/12; E21B 29/00; E21B 29/02

(Continued)

(56) References Cited

U.S. PATENT DOCUMENTS 5,234,055 A 8/1993 Cornette
5,579,844 A 12/1996 Rebardi et al.

(Continued)

OTHER PUBLICATIONS

Khemani, K. et al. (2012), "Introduction and Overview of Degradable and Renewable Polymers and Materials," Degradable Polymers and Materials: Principles and Practice, Chapter 1, pp. 3-10.

(Continued)

*Primary Examiner* — Kenneth L Thompson
(74) *Attorney, Agent, or Firm* — ExxonMobil Upstream Research Company Law Deparment

(57) ABSTRACT

Corrodible wellbore plugs, systems and methods are disclosed herein. The methods include flowing a corrodible wellbore plug that is at least partially formed from a corrodible metal to a downhole location within a wellbore conduit and retaining the corrodible wellbore plug at the downhole location by operatively engaging an engagement structure with a wellbore tubular that defines the wellbore conduit. The methods include pressurizing a portion of the wellbore conduit uphole from the corrodible wellbore plug and flowing a corrosive reservoir fluid from the subterranean formation into contact with the corrodible metal to release the corrodible wellbore plug from the downhole location. The methods also may include removing the wellbore plug without utilizing a drill-out process. The systems include a corrodible wellbore plug that includes a plug body and a retention mechanism, which includes a slip ring formed from the corrodible metal and that includes the engagement structure.

29 Claims, 10 Drawing Sheets

(58) Field of Classification Search
USPC ..... 166/376
See application file for complete search history.

(56) References Cited

U.S. PATENT DOCUMENTS

| | | | | |
|---|---|---|---|---|
| 5,704,426 | A | 1/1998 | Rytlewski et al. | |
| 5,829,520 | A | 11/1998 | Johnson | |
| 6,543,538 | B2 | 4/2003 | Tolman et al. | |
| 6,907,936 | B2 | 6/2005 | Fehr et al. | |
| 6,957,701 | B2 | 10/2005 | Tolman et al. | |
| 7,059,407 | B2 | 6/2006 | Tolman et al. | |
| 7,168,494 | B2 | 1/2007 | Starr et al. | |
| 7,353,879 | B2 | 4/2008 | Todd et al. | |
| 7,477,160 | B2 | 1/2009 | Lemenager et al. | |
| 7,516,792 | B2 | 4/2009 | Lonnes et al. | |
| 7,575,062 | B2 | 8/2009 | East, Jr. | |
| 7,735,559 | B2 | 6/2010 | Malone | |
| 7,798,236 | B2 * | 9/2010 | McKeachnie | E21B 33/1294 166/317 |
| 8,127,856 | B1 * | 3/2012 | Nish | E21B 33/1294 166/133 |
| 8,167,047 | B2 | 5/2012 | Themig et al. | |
| 8,215,411 | B2 | 7/2012 | Flores et al. | |
| 8,220,542 | B2 | 7/2012 | Whitsitt et al. | |
| 8,237,585 | B2 | 8/2012 | Zimmerman | |
| 8,267,177 | B1 | 9/2012 | Vogel et al. | |
| 8,276,670 | B2 | 10/2012 | Patel | |
| 8,330,617 | B2 | 12/2012 | Chen et al. | |
| 8,347,982 | B2 | 1/2013 | Hannegan et al. | |
| 8,459,346 | B2 * | 6/2013 | Frazier | E21B 33/134 166/124 |
| 8,496,055 | B2 | 7/2013 | Mootoo et al. | |
| 8,950,504 | B2 * | 2/2015 | Xu | E21B 23/01 166/382 |
| 9,027,655 | B2 * | 5/2015 | Xu | E21B 23/01 166/376 |
| 9,181,772 | B2 * | 11/2015 | Frazier | E21B 33/134 |
| 2002/0007949 | A1 | 1/2002 | Tolman et al. | |
| 2004/0084190 | A1 | 5/2004 | Hill et al. | |
| 2006/0118301 | A1 | 6/2006 | East, Jr. et al. | |
| 2008/0093073 | A1 | 4/2008 | Bustos et al. | |
| 2009/0032255 | A1 | 2/2009 | Surjaatmadja et al. | |
| 2009/0101334 | A1 | 4/2009 | Baser et al. | |
| 2010/0084134 | A1 | 4/2010 | Tulissi et al. | |
| 2011/0048743 | A1 | 3/2011 | Stafford et al. | |
| 2011/0067889 | A1 * | 3/2011 | Marya | E21B 33/134 166/386 |
| 2011/0168403 | A1 | 7/2011 | Patel | |
| 2012/0043079 | A1 | 2/2012 | Wassouf et al. | |
| 2012/0085548 | A1 | 4/2012 | Fleckenstein et al. | |
| 2012/0090687 | A1 | 4/2012 | Grigsby et al. | |
| 2012/0111566 | A1 | 5/2012 | Sherman et al. | |
| 2012/0199349 | A1 | 8/2012 | Themig et al. | |
| 2012/0292053 | A1 | 11/2012 | Xu et al. | |
| 2013/0008648 | A1 | 1/2013 | Lovorn et al. | |
| 2013/0105159 | A1 | 5/2013 | Alvarez et al. | |
| 2013/0199790 | A1 | 8/2013 | Themig et al. | |
| 2013/0206425 | A1 | 8/2013 | Mazyar et al. | |
| 2013/0248174 | A1 | 9/2013 | Dale et al. | |
| 2014/0110112 | A1 * | 4/2014 | Jordan, Jr. | E21B 33/1293 166/281 |
| 2014/0311752 | A1 * | 10/2014 | Streich | E21B 33/134 166/376 |
| 2016/0290090 | A1 * | 10/2016 | Murphree | E21B 33/12 |

OTHER PUBLICATIONS

Luckachan, G.E. et al. (2011), Biodegradable Polymers—A Review on Recent Trends and Emerging Perspectives, *J Polym. Environ*. 18, pp. 637-676.

Marechal, F. (2003), "Biodegradable Plastics," Biodegradable Polymers and Plastics, pp. 67-71.

Scott, G. (2002), "Degradation and Stabilization of Carbon-Chain Polymers," Degradable Polymers: Principles and Applications, 2nd Edition, pp. 27-50, 379-412.

Swift, G. (2002), "Environmentally Biodegradable Water-Soluble Polymers," Degradable Polymers: Principles and Applications, 2nd Edition, pp. 379-412.

* cited by examiner

CORRODIBLE WELLBORE PLUGS AND SYSTEMS AND METHODS INCLUDING THE SAME

CROSS-REFERENCE TO RELATED APPLICATION

This application claims priority to U.S. Provisional Patent Application No. 61/946,590, filed Feb. 28, 2014, entitled CORRODIBLE ALUMINUM TOOLS AND PLUGS, and U.S. Provisional Patent Application No. 62/023,679, filed Jul. 11, 2014, entitled CORRODIBLE WELLBORE PLUGS AND SYSTEMS AND METHODS INCLUDING THE SAME, both of which are incorporated in their entirety herein.

FIELD OF THE DISCLOSURE

The present disclosure is directed to corrodible wellbore plugs and to methods of utilizing corrodible wellbore plugs.

BACKGROUND OF THE DISCLOSURE

A variety of wellbore plugs may be utilized to restrict and/or block fluid flow within a hydrocarbon well that includes a wellbore conduit that extends within a subterranean formation. Often, a wellbore plug is utilized for a period of time and subsequently is removed from the wellbore conduit. As an example, a plug may be utilized to fluidly isolate an uphole portion of the wellbore conduit from a downhole portion of the wellbore conduit. This fluid isolation may permit pressurization of the uphole portion of the wellbore conduit and/or may be utilized to regulate flow of a stimulation fluid from the wellbore conduit into the subterranean formation.

However, subsequent to formation and/or completion of the hydrocarbon well, it may be desirable to remove the wellbore plug from the wellbore conduit. Generally, wellbore plugs are removed from the wellbore conduit utilizing a drill-out process. In such a process, a drill bit is utilized to drill the wellbore plug, thereby decreasing and/or eliminating any flow restriction that was caused by the presence of the wellbore plug within the wellbore conduit. While such a drill-out process may be effective at removing the wellbore plug, drill-out processes are costly, time-intensive, and/or labor intensive. In addition, the functionality and/or integrity of the hydrocarbon well may be at risk during the drill-out process.

As hydrocarbon wells are drilled longer and/or deeper into subterranean formations, these costs and/or risks increase. Thus, there exists a need for wellbore plugs that may be removed from the wellbore conduit without utilizing a drill-out process and for systems and methods that utilize such plugs.

SUMMARY OF THE DISCLOSURE

Corrodible wellbore plugs and systems and methods including the same are disclosed herein. The methods may include flowing a corrodible wellbore plug that is at least partially formed from a corrodible metal to a downhole location within a wellbore conduit and retaining the corrodible wellbore plug at the downhole location by operatively engaging an engagement structure with a wellbore tubular that defines the wellbore conduit. The methods may include pressurizing a portion of the wellbore conduit that is uphole from the corrodible wellbore plug. The methods may include removing the retained wellbore plug without utilizing a drill-out process, such as by selective contact with a corrosive reservoir fluid from the subterranean formation. The methods thus also may include flowing a corrosive reservoir fluid from the subterranean formation and into contact with the corrodible metal to release the corrodible wellbore plug from the downhole location.

In some embodiments, the retaining may include expanding a slip ring of the corrodible wellbore plug to operatively engage the slip ring with the wellbore tubular. In some embodiments, the slip ring may be at least partially formed from the corrodible metal. In some embodiments, the retaining may include operatively engaging an engagement structure of the slip ring with the wellbore tubular.

In some embodiments, the methods further may include forming a fluid seal between the corrodible wellbore plug and the wellbore tubular with a sealing element. In some embodiments, the methods further may include cold welding the corrodible wellbore plug to the wellbore tubular. In some embodiments, the methods further may include galling the wellbore tubular with the corrodible wellbore plug.

In some embodiments, the methods further may include stimulating the subterranean formation with the pressurizing fluid. In some embodiments, the stimulating may include perforating the wellbore tubular responsive to a pressure within the portion of the wellbore tubular that is uphole from the corrodible wellbore plug exceeding a threshold perforating pressure. In some embodiments, the methods may include sealing the perforation with a ball sealer and/or creating a second perforation within the wellbore tubular.

In some embodiments, the methods further may include generating turbulent flow within the corrosive reservoir fluid and in contact with the corrodible wellbore plug to accelerate corrosion of the corrodible wellbore plug. In some embodiments, the flowing the corrosive reservoir fluid may include heating the corrodible wellbore plug to a temperature of at least 100 degrees Celsius and exposing the corrodible wellbore plug to a pH of less than 4.5. In some embodiments, the flowing the corrosive reservoir fluid may include contacting the corrosive reservoir fluid with the corrodible wellbore plug at a pressure of at least 5 megapascals. In some embodiments, the corrosive reservoir fluid may include at least 1.0 mole percent carbon dioxide and the flowing the corrosive reservoir fluid may include contacting the corrodible wellbore plug with the carbon dioxide.

In some embodiments, the methods further may include waiting at least a threshold corrosion time for the corrodible wellbore plug to be released from the downhole location. In some embodiments, the threshold corrosion time is at least 1 day and less than 90 days.

In some embodiments, the corrodible wellbore plug further includes a reinforcing material that does not corrode within the corrosive reservoir fluid. In some embodiments, the reinforcing material defines a plurality of reinforcing bodies and the corrodible metallic portion retains the plurality of reinforcing bodies within the corrodible wellbore plug.

The systems include a corrodible wellbore plug that includes a plug body and a retention mechanism. The retention mechanism includes a slip ring, which is formed from the corrodible metal and includes an engagement structure.

In some embodiments, the retention mechanism may include a cone and a mandrel. In some embodiments, at least one of the cone and the mandrel is formed from a corrodible metal. In some embodiments, the mandrel is a hollow cylindrical mandrel that defines a mandrel conduit. In some embodiments, the corrodible wellbore plug may include a turbulence-generating structure that is configured to generate turbulence within fluid flow through the mandrel conduit.

In some embodiments, the corrodible wellbore plug is a corrodible bridge plug that restricts fluid flow in the wellbore conduit past the plug in both the uphole and downhole directions. In some embodiments, the corrodible wellbore plug is a corrodible frac plug. In some such embodiments, the corrodible frac plug may include a flow-control device. The flow-control device may be configured to permit fluid flow past the corrodible frac plug in an uphole direction but to restrict fluid flow through the corrodible frac plug in a downhole direction.

In some embodiments, the engagement structure may be operatively attached to the slip ring. In some embodiments, the engagement structure may be at least partially embedded in the slip ring. In some embodiments, the engagement structure may be a surface treatment that coats a peripheral surface of the slip ring. In some embodiments, the engagement structure may be a cladding that covers the peripheral surface of the slip ring. In some embodiments, the engagement structure may be a surface texture that is defined by the slip ring. In some embodiments, the engagement structure has a hardness that is at least two times greater than a hardness of the slip ring.

In some embodiments, the corrodible wellbore plug further may include a sealing element. In some embodiments, the corrodible wellbore plug further may include a reinforcing body.

In some embodiments, the corrodible wellbore plug may be retained within a wellbore conduit of a hydrocarbon well. In some embodiments, at least a portion of the corrodible metal may be corroded by the corrosive reservoir fluid.

DETAILED DESCRIPTION AND BEST MODE OF THE DISCLOSURE

Figure 1:
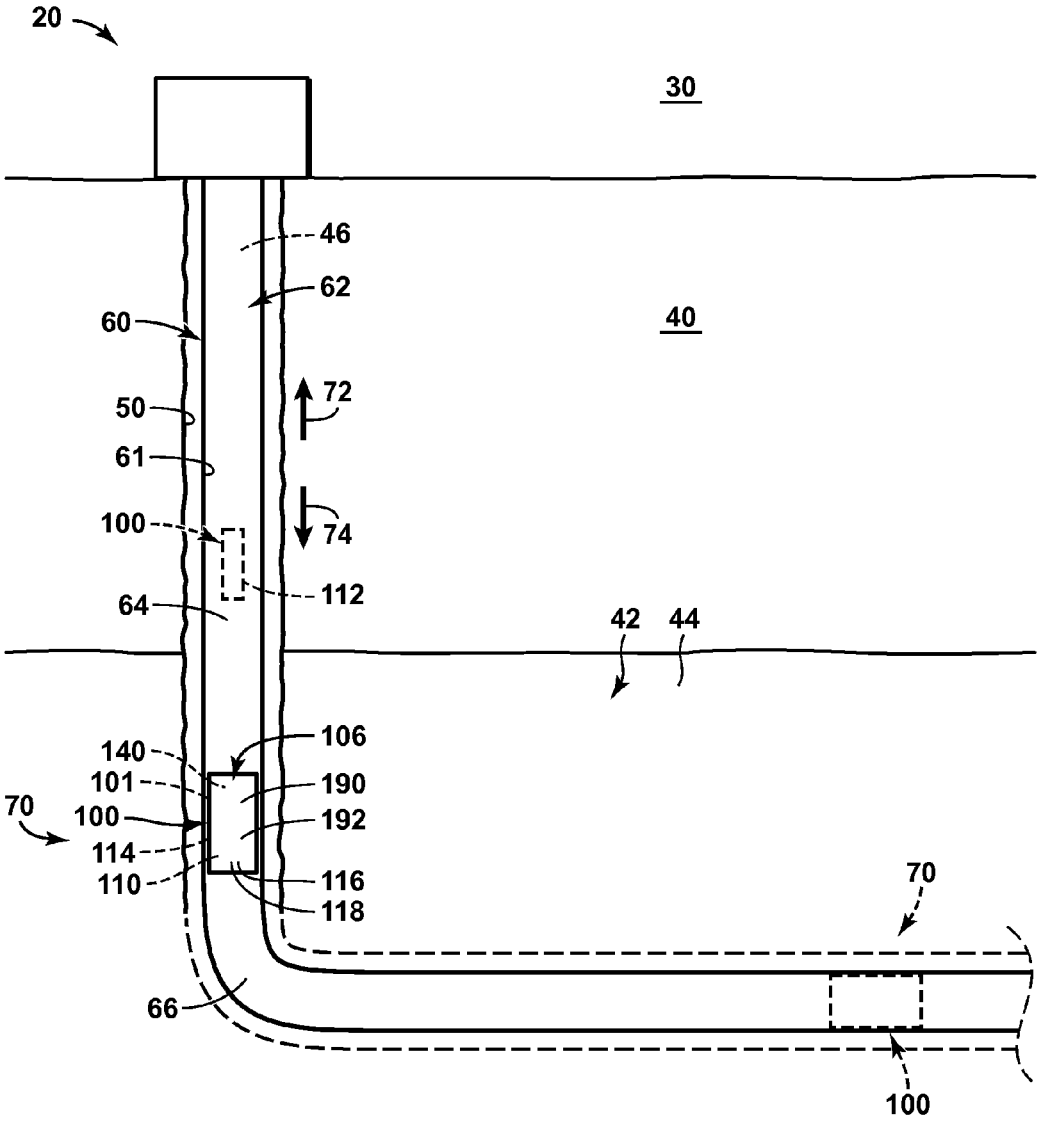
FIG. 1 is a schematic representation of examples of a hydrocarbon well that may include and/or utilize corrodible wellbore plugs according to the present disclosure.

FIGS. 1-13 provide illustrative, non-exclusive examples of corrodible wellbore plugs 100 according to the present disclosure, components of corrodible wellbore plugs 100, hydrocarbon wells 20 that include and/or utilize corrodible wellbore plugs 100, and/or methods that may include and/or utilize corrodible wellbore plugs 100. Elements that serve a similar, or at least substantially similar, purpose are labeled with like numbers in each of FIGS. 1-13, and these elements may not be discussed in detail herein with reference to each of FIGS. 1-13. Similarly, all elements may not be labeled in each of FIGS. 1-13, but reference numerals associated therewith may be utilized herein for consistency. Elements, components, and/or features that are discussed herein with reference to one or more of FIGS. 1-13 may be included in and/or utilized with any of FIGS. 1-13 without departing from the scope of the present disclosure.

In general, elements that are likely to be included are illustrated in solid lines, while elements that are optional are illustrated in dashed lines. However, elements that are shown in solid lines may not be essential. Thus, an element shown in solid lines may be omitted without departing from the scope of the present disclosure.

FIG. 1 is a schematic representation of examples of a hydrocarbon well 20 that may include and/or utilize corrodible wellbore plugs 100 according to the present disclosure. Hydrocarbon well 20 includes a wellbore 50 that extends between a surface region 30 and a subterranean formation 42 that may be present in a subsurface region 40. Subterranean formation 42 includes and/or contains a corrosive reservoir fluid 44. The corrosive reservoir fluid is naturally occurring in, or within, subterranean formation 42 and/or is native to subterranean formation 42.

A wellbore tubular 60 extends within wellbore 50 and defines a wellbore conduit 62. As illustrated in solid lines in FIG. 1, wellbore 50 may include a vertical portion (or hydrocarbon well 20 may be a vertical hydrocarbon well). Additionally or alternatively, and as illustrated in dashed lines in FIG. 1, wellbore 50 also may include a horizontal portion (or hydrocarbon well 20 may be a horizontal, or deviated, hydrocarbon well).

Corrodible wellbore plug 100 is located, present, and/or retained within wellbore conduit 62. Corrodible wellbore plug 100 includes a corrodible portion 190 that is formed from a corrodible metal 192. As discussed in more detail herein with reference to methods 200 and 300 of FIGS. 12 and 13, respectively, the corrodible metal is selected to corrode when in contact with corrosive reservoir fluid 44 but not to corrode when in contact with a pressurizing fluid 46 that may be provided to wellbore conduit 62 from surface region 30. This may permit corrodible wellbore plug 100 to be selectively removed from wellbore conduit 62 (via selective contact between the corrodible wellbore plug and corrosive reservoir fluid 44 and resultant corrosion of the corrodible wellbore plug) without the need to drill-out, or otherwise manually remove, the corrodible wellbore plug from the wellbore conduit.

Corrodible wellbore plug 100 includes a plug body 106 and retention mechanism 110. Plug body 106 is sized and/or shaped to be located, placed, and/or present within wellbore conduit 62. Retention mechanism 110 is configured to selectively retain the corrodible wellbore plug within the wellbore conduit. As discussed in more detail herein, the retention mechanism may be selectively transitioned from a mobile conformation 112 to a retained conformation 114 (as schematically illustrated in FIG. 1). In mobile conformation 112, the retention mechanism permits motion of the corrodible wellbore plug within the wellbore conduit (e.g., the corrodible wellbore plug is free to rotate and/or translate within wellbore conduit 62). In retained conformation 114, the retention mechanism retains the corrodible wellbore plug at a downhole location 70 within the wellbore conduit, such as via operative engagement between the corrodible wellbore plug and an inner surface 61 of wellbore tubular 60. As illustrated in solid lines in FIG. 1, downhole location 70 may be within the vertical portion of wellbore 50. Additionally or alternatively, and as illustrated in dashed lines in FIG. 1, downhole location 70 also may be within the horizontal portion of wellbore 50. In addition, hydrocarbon well 20 may include any suitable number of corrodible wellbore plugs 100 at a given point in time.

Retention mechanism 110 includes a slip ring 116 and an engagement structure 118. Slip ring 116 may define a retracted conformation when the retention mechanism is in the mobile conformation. In addition, slip ring 116 may define an expanded conformation when the retention mechanism is in the retained conformation. Engagement structure 118 may be configured to operatively engage wellbore tubular 60, such as the inner surface 61 thereof, when slip ring 116 is in (or responsive to slip ring 116 transitioning to) the expanded conformation.

At least a portion of corrodible wellbore plug 100 may be formed from and/or may include corrodible metallic portion 190 that may be formed from corrodible metal 192. As an example, slip ring 116 may be formed from and/or may include corrodible metallic portion 190. As another example, another portion of corrodible wellbore plug 100, such as at least a portion of plug body 106, may be formed from and/or may include corrodible metallic portion 190. The corrodible metal may be selected to corrode upon contact with, responsive to contact with, and/or when in contact with corrosive reservoir fluid 44. Thus, and when corrosive reservoir fluid 44 is contacting, directly contacting, in contact with, and/or in fluid contact with corrodible wellbore plug 100, the corrosive reservoir fluid may corrode at least a portion of the corrodible wellbore plug, such as corrodible metallic portion 190 thereof.

Corrodible wellbore plug 100 may be designed and/or configured to control and/or regulate a fluid flow within wellbore conduit 62. As an example, corrodible wellbore plug 100 may be configured to restrict, regulate, and/or control fluid flow between a portion of wellbore conduit 62 that is uphole from the corrodible wellbore plug (i.e., an uphole portion 64 of wellbore conduit 62) and a portion of wellbore conduit 62 that is downhole from the corrodible wellbore plug (i.e., a downhole portion 66 of wellbore conduit 62).

As illustrated in dashed lines in FIG. 1 and discussed in more detail herein, corrodible wellbore plug 100 also may include a flow-control device 140. When corrodible wellbore plug 100 includes flow-control device 140, the corrodible wellbore plug also may be referred to herein as a corrodible frac plug 101, as a corrodible fracture plug 101, as a corrodible fracturing plug 101, and/or as a corrodible stimulation plug 101. When corrodible wellbore plug 100 does not include flow-control device 140, the corrodible wellbore plug also may be referred to herein as a corrodible bridge plug. Flow-control device 140 may be configured to permit fluid flow therethrough and/or past corrodible frac plug 101 in an uphole direction 72 (i.e., from downhole portion 66 to uphole portion 64) when the corrodible frac plug is retained within the wellbore conduit. In addition, flow-control device 140 also may be configured to restrict and/or block fluid flow therethrough and/or past corrodible frac plug 101 in a downhole direction 74 (i.e., from uphole portion 64 to downhole portion 66) when the corrodible frac plug is retained within the wellbore conduit.

Corrosive reservoir fluid 44 may include and/or be any naturally occurring, or native, reservoir fluid that is present within subterranean formation 42 and that corrodes corrodible metal 192 when in contact therewith. Corrosive reservoir fluid 44 may include reservoir fluids that are present within the subterranean formation prior to construction of hydrocarbon well 20 and/or prior to wellbore 50 being present and/or defined within the subterranean formation. As an example, certain regions within the Bakken formation in North America may include naturally occurring corrosive reservoir fluids as referred to, defined by, and/or utilized in the present disclosure.

It is within the scope of the present disclosure that corrosive reservoir fluid 44 may corrode corrodible metallic portion 190 in any suitable manner and/or utilizing any suitable mechanism. As an example, corrosive reservoir fluid 44 may have a low pH and/or may be acidic. As more specific examples, corrosive reservoir fluid 44 may have a pH of less than 6.0, less than 5.5, less than 5.0, less than 4.5, less than 4.0, less than 3.5, or less than 3.0. As additional more specific examples, corrosive reservoir fluid 44 also may have a carbon dioxide content of at least 0.25 mole percent, at least 0.5 mole percent, at least 0.75 mole percent, at least 1.0 mole percent, at least 1.25 mole percent, at least 1.5 mole percent, at least 1.75 mole percent, or at least 2.0 mole percent. As additional more specific examples, corrosive reservoir fluid 44 also may have a chloride ion content of at least 10,000 parts per million (PPM), at least 25,000 PPM, at least 50,000 PPM, at least 75,000 PPM, at least 100,000 PPM, at least 125,000 PPM, at least 150,000 PPM, at least 175,000 PPM, or at least 200,000 PPM.

Corrosive reservoir fluid 44 may have any suitable temperature and/or pressure within subterranean formation 42. As examples, the temperature of corrosive reservoir fluid 44 within subterranean formation 42, at downhole location 70, and/or in contact with corrodible wellbore plug 100 may be at least 30 degrees Celsius, at least 40 degrees Celsius, at least 50 degrees Celsius, at least 60 degrees Celsius, at least 70 degrees Celsius, at least 80 degrees Celsius, at least 90 degrees Celsius, at least 100 degrees Celsius, at least 110 degrees Celsius, at least 120 degrees Celsius, at least 130 degrees Celsius, at least 140 degrees Celsius, or at least 150 degrees Celsius. As additional examples, the pressure of corrosive reservoir fluid 44 within subterranean formation 42, at downhole location 70, and/or in contact with corrodible wellbore plug 100 may be at least 1 megapascals, at least 2 megapascals, at least 2.5 megapascals, at least 3 megapascals, at least 3.5 megapascals, at least 4 megapascals, at least 4.5 megapascals, at least 5 megapascals, at least 5.5 megapascals, at least 6 megapascals, at least 6.5 megapascals, at least 7 megapascals, at least 7.5 megapascals, at least 8 megapascals, at least 8.5 megapascals, at least 9 megapascals, at least 9.5 megapascals, or at least 10 megapascals.

Corrodible metallic portion 190, or corrodible metal 192 thereof, may be formed from any suitable metal that is selected to corrode when in contact with corrosive reservoir fluid 44 and/or at the environmental conditions that are present within downhole location 70. As examples, the corrodible metal may include and/or be aluminum, an aluminum alloy, magnesium, a magnesium alloy, manganese, a manganese alloy, zinc, a zinc alloy, cadmium, a cadmium alloy, calcium, a calcium alloy, cobalt, a cobalt alloy, copper, a copper alloy, iron, an iron alloy, nickel, a nickel alloy, silicon, a silicon alloy, silver, a silver alloy, strontium, a strontium alloy, thorium, a thorium alloy, zirconium, a zirconium alloy, and mixtures and/or combinations thereof.

Regardless of the exact material(s) that define corrodible metallic portion 190 and/or that comprise corrodible metal 192, the corrodible metallic portion may be selected to completely corrode, or dissolve, within corrosive reservoir fluid 44 after contact with the corrosive reservoir fluid for a threshold corrosion time. Alternatively, corrodible metallic portion 190 may not completely corrode, or dissolve within corrosive reservoir fluid 44 within the threshold corrosion time but instead may partially corrode, or dissolve, an amount sufficient to release corrodible wellbore plug 100 from being retained at downhole location 70. As examples, corrodible wellbore plug 100 may decrease in size, decrease in volume, decrease in mass, and/or break apart subsequent (or responsive) to corrosion of corrodible metallic portion 190. Thus, subsequent to the threshold corrosion time, corrodible wellbore plug 100 may no longer be present within wellbore conduit 62, corrodible wellbore plug 100 may be free to translate within wellbore conduit 62, corrodible wellbore plug 100 may be free to rotate within wellbore conduit 62, and/or fluid may be free to flow within wellbore conduit 62 (at least substantially) without restriction by corrodible wellbore plug 100.

Examples of the threshold corrosion time include threshold corrosion times of at least 1 hour, at least 2 hours, at least 4 hours, at least 6 hours, at least 12 hours, at least 18 hours, at least 1 day, at least 2 days, at least 4 days, at least 6 days, at least 8 days, at least 10 days, at least 15 days, at least 30 days, at least 45 days, at least 60 days, at least 75 days, or at least 90 days. Additionally or alternatively, the threshold corrosion time may be less than 150 days, less than 140 days, less than 130 days, less than 120 days, less than 110 days, less than 100 days, less than 90 days, less than 80 days, less than 70 days, less than 60 days, less than 50 days, less than 40 days, less than 30 days, less than 20 days, or less than 10 days. This may include any time range that may be between any one of the above-listed lower values and any one of the above-listed upper values.

Corrodible metallic portion 190 or corrodible metal 192 thereof may form any suitable portion, or fraction, of corrodible wellbore plug 100. As examples, corrodible metal 192 may form at least 1 weight percent, at least 2 weight percent, at least 3 weight percent, at least 4 weight percent, at least 5 weight percent, at least 7.5 weight percent, at least 10 weight percent, at least 15 weight percent, at least 20 weight percent, at least 25 weight percent, at least 30 weight percent, at least 40 weight percent, at least 50 weight percent, at least 60 weight percent, at least 70 weight percent, at least 80 weight percent, at least 85 weight percent, at least 90 weight percent, at least 92.5 weight percent, at least 95 weight percent, at least 96 weight percent, at least 97 weight percent, at least 98 weight percent, at least 99 weight percent, and/or 100 weight percent of corrodible wellbore plug 100. More specific examples of portions of corrodible wellbore plug 100 that may be formed from corrodible metal 192 are disclosed herein.

Corrodible metallic portion 190 may be corroded by corrosive reservoir fluid 44 in any suitable manner. As an example, corrosive reservoir fluid 44 and corrodible metallic portion 190 together may undergo an oxidation-reduction reaction that may ionize corrodible metallic portion 190 (or corrodible metal 192 thereof), thereby solubilizing, or dissolving, corrodible metal 192 within corrosive reservoir fluid 44. As another example, corrodible metallic portion 190 may be in electrical communication with wellbore tubular 60 and may function, or act, as a sacrificial anode for wellbore tubular 60. Under these conditions, corrodible metal 192 may be selected to have a higher galvanic activity than that of wellbore tubular 60, which may cause corrodible metal 192 to be preferentially corroded by corrosive reservoir fluid 44.

As used herein, the terms "corrode," "corrodes," "corroding," and/or "corrodible" may be utilized to indicate that a structure, element, component, and/or feature, such as may form a portion of corrodible metallic portion 190 and/or may be formed from corrodible metal 192, corrodes when in contact with corrosive reservoir fluid 44. For example, a structure, element, component, and/or feature may be described herein as corrodible if the structure, element, component, and/or feature completely corrodes away responsive to contact with corrosive reservoir fluid 44 and/or completely corrodes away responsive to contact with corrosive reservoir fluid 44 for the threshold corrosion time. As another example, a structure, element, component, and/or feature may be described herein as corrodible if the structure, element, component, and/or feature loses at least a threshold lost fraction of its structural integrity responsive to contact with corrosive reservoir fluid 44 and/or responsive to contact with corrosive reservoir fluid 44 for the threshold corrosion time. Examples of the threshold lost fraction of the structural integrity include at least 50%, at least 60%, at least 70%, at least 80%, at least 90%, at least 95%, or 100% of the structural integrity. As yet another example, a structure, element, component, and/or feature may be described herein as corrodible if the structure, element, component, and/or feature fails to function as originally intended, fails to function in a manner that is consistent with its function prior to contact with corrosive reservoir fluid 44, and/or fails to restrict (or facilitate corrodible wellbore plug 100 in restricting) fluid flow within wellbore conduit 62 responsive to contact with corrosive reservoir fluid 44 and/or responsive to contact with corrosive reservoir fluid 44 for the threshold corrosion time.

Conversely, a structure, element, component, and/or feature may be described herein as not corroding within corrosive reservoir fluid 44 and/or as resisting corrosion by corrosive reservoir fluid 44 when the structure, element, component, and/or feature does not form a portion of corrodible metallic portion 190 and/or is not formed from corrodible metal 192. For example, a structure, element, component, and/or feature may be described herein as resisting corrosion within corrosive reservoir fluid 44 if the structure, element, component, and/or feature does not completely corrode away responsive to contact with corrosive reservoir fluid 44 and/or responsive to contact with corrosive reservoir fluid 44 for at least the threshold corrosion time. As another example, a structure, element, component, and/or feature may be described herein as resisting corrosion within corrosive reservoir fluid 44 if the structure, element, component, and/or feature retains at least a threshold retained fraction of its structural integrity during contact with corrosive reservoir fluid 44 and/or after contact with corrosive reservoir fluid 44 for at least the threshold corrosion time. Examples of the threshold retained fraction of the structural integrity include at least 50%, at least 60%, at least 70%, at least 80%, at least 90%, at least 95%, or 100% of the structural integrity. As yet another example, a structure, element, component, and/or feature may be described herein as resisting corrosion within corrosive reservoir fluid 44 if the structure, element, component, and/or feature continues to function as originally intended, continues to function in a manner that is consistent with its function prior to contact with corrosive reservoir fluid 44, and/or continues to restrict (or facilitate corrodible wellbore plug 100 in restricting) fluid flow within wellbore conduit 62 after contact with corrosive reservoir fluid 44 and/or after contact with corrosive reservoir fluid 44 for at least the threshold corrosion time.

A difference and/or distinction between structures, elements, components, and/or features that are corrodible responsive to contact with corrosive reservoir fluid 44 and structures, elements, components, and/or features that resist corrosion by corrosive reservoir fluid 44 also may be described herein by a weight percentage of the structures, elements, components, and/or features that remains after contact with corrosive reservoir fluid 44 and/or after contact with corrosive reservoir fluid 44 for at least the threshold corrosion time. For example, a structure, element, component, and/or feature may be described herein as corrodible by corrosive reservoir fluid 44 if at least a threshold weight percentage of the structure, element, component, and/or feature corrodes away after contact with corrosive reservoir fluid 44 and/or after contact with corrosive reservoir fluid 44 for at least the threshold corrosion time. Examples of the threshold weight percentage of the structure, element, component, and/or feature that corrodes away include at least 30 wt %, at least 40 wt %, at least 50 wt %, at least 60 wt %, at least 70 wt %, at least 80 wt %, at least 90 wt %, at least 95 wt %, at least 99%, or 100 wt %.

As another example, a structure, element, component, and/or feature may be described herein as resisting corrosion by corrosive reservoir fluid 44 if at least a threshold weight percentage of the structure, element, component, and/or feature does not corrode away after contact with corrosive reservoir fluid 44 and/or after contact with corrosive reservoir fluid 44 for at least the threshold corrosion time. Examples of the threshold weight percentage of the structure, element, component, and/or feature that does not corrode away include less than 50%, less than 40%, less than 30%, less than 20%, less than 10%, less than 5%, less than 1%, or 0%.

Corrodible wellbore plug 100 and/or corrodible metallic portion 190 thereof may contact corrosive reservoir fluid 44 in any suitable manner. As an example, and when corrodible wellbore plug 100 includes flow-control device 140, corrosive reservoir fluid 44 may be flowed through the flow-control device. As additional examples, corrodible metallic portion 190 may contact corrosive reservoir fluid 44 via, responsive to, or as a result of diffusion, naturally occurring subterranean flows, production of corrosive reservoir fluid 44 from hydrocarbon well 20, production of corrosive reservoir fluid 44 from another hydrocarbon well that may be present within subterranean formation 42, and/or injection of another fluid into subterranean formation 42 from the other hydrocarbon well.

FIGS. 2-11 provide additional examples of corrodible wellbore plugs 100 according to the present disclosure and/or components and/or features thereof. It is within the scope of the present disclosure that any of the corrodible wellbore plugs that are discussed herein with reference to FIGS. 2-11 may be utilized and/or included in hydrocarbon well 20 of FIG. 1. Similarly, any of the components and/or features of the corrodible wellbore plug of FIG. 1 may be utilized and/or included in the corrodible wellbore plugs of FIGS. 2-11.

Figure 2:
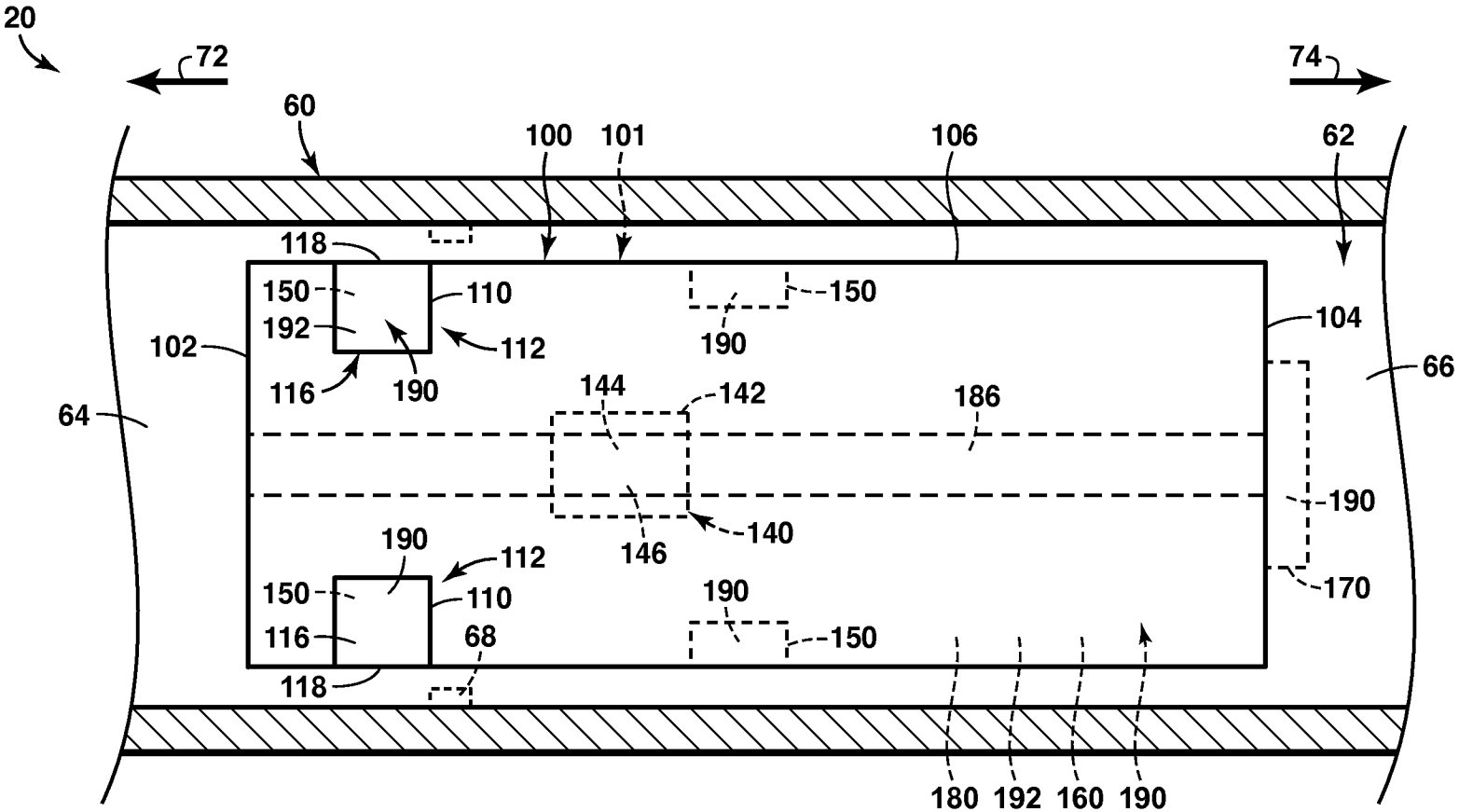
FIG. 2 is a schematic representation of a corrodible wellbore plug, according to the present disclosure, that includes a retention mechanism that is in a mobile conformation.
Figure 3:
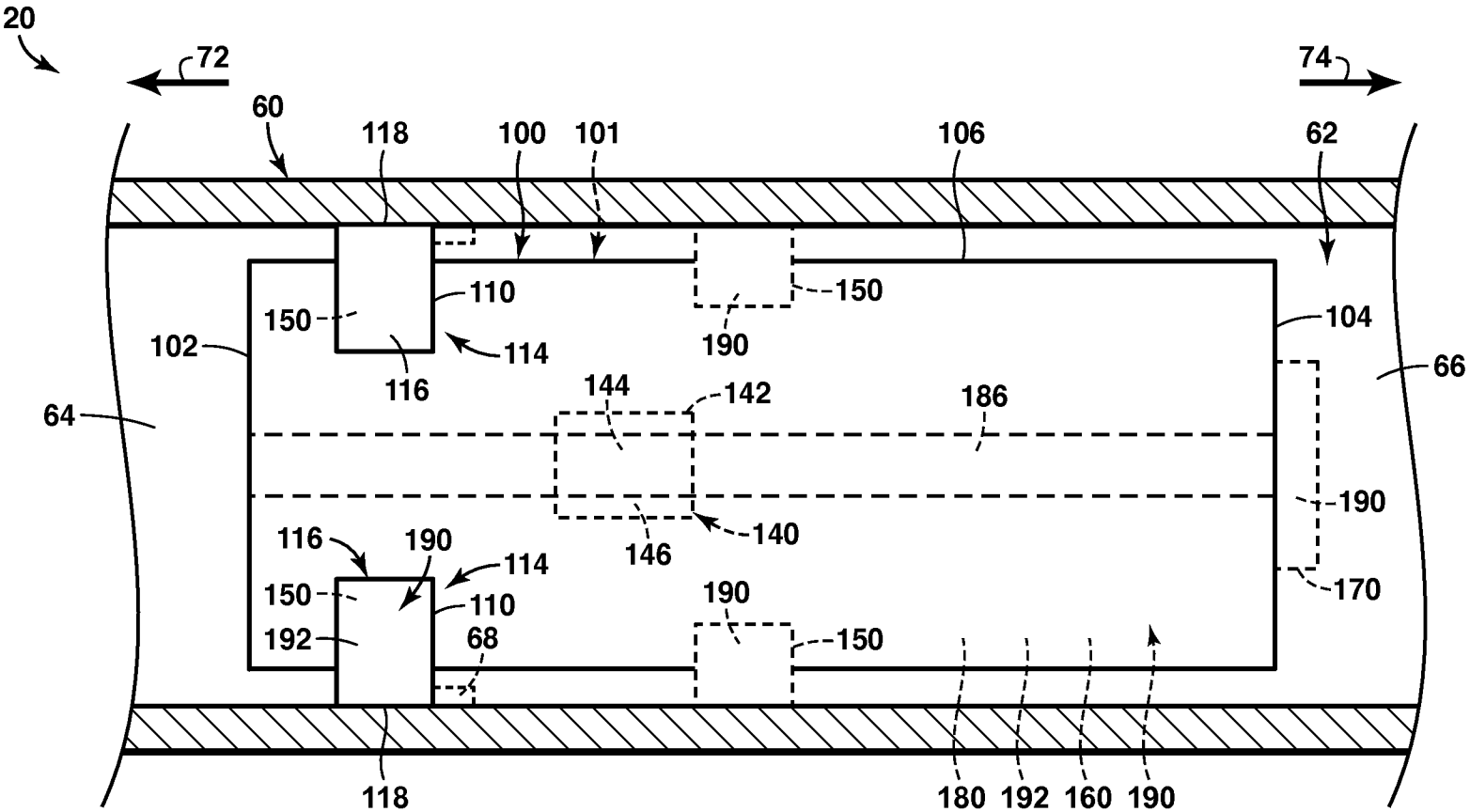
FIG. 3 is a schematic representation of the corrodible wellbore plug of FIG. 2 with the retention mechanism in a retained conformation.

FIGS. 2-3 are schematic representations of corrodible wellbore plugs 100 according to the present disclosure. Corrodible wellbore plugs 100 of FIGS. 2-3 are present within a wellbore conduit 62 that is defined by a wellbore tubular 60 and include a plug body 106 and a retention mechanism 110. FIG. 2 schematically illustrates retention mechanism 110 in a mobile conformation 112, while FIG. 3 schematically illustrates retention mechanism 110 in a retained conformation 114.

Retention mechanism 110 includes a slip ring 116 that is formed from a corrodible metal 192 and/or which defines at least a portion of corrodible metallic portion 190. Slip ring 116 defines a retracted conformation when retention mechanism 110 is in a mobile conformation 112 (as illustrated in FIG. 2) and an expanded conformation when retention mechanism 110 is in a retained conformation 114 (as illustrated in FIG. 3).

Retention mechanism 110 also includes an engagement structure 118. Engagement structure 118 is configured to operatively engage wellbore tubular 60 when retention mechanism 110 transitions (or responsive to retention mechanism 110 transitioning) from mobile conformation 112 to retained conformation 114. This operative engagement between engagement structure 118 and wellbore tubular 60 may retain, or immobilize, corrodible wellbore plug 100 within wellbore conduit 62.

Engagement structure 118 may be configured to move and/or translate with slip ring 116. As examples, engagement structure 118 may be operatively attached to slip ring 116, may be at least partially embedded within slip ring 116, may be a surface treatment that coats a peripheral surface of slip ring 116, and/or may be a surface texture that is defined by, or with, slip ring 116. Examples of the surface texture include a roughened surface, a grooved surface, a knurled surface, and/or a projection that extends from the slip ring.

As discussed, slip ring 116 may be formed from corrodible metal 192. Generally, corrodible metal 192 may be softer than a material that defines wellbore tubular 60. As such, slip ring 116 may not, or may not significantly, deform wellbore tubular 60 when retention mechanism 110 transitions to the retained conformation. Thus, slip ring 116 may not provide a sufficient holding force to resist motion of corrodible wellbore plug 100 within wellbore conduit 62 when a pressure differential is developed between uphole portion 64 and downhole portion 66 of wellbore conduit 62.

However, engagement structure 118 may operate in conjunction with slip ring 116 and may provide a sufficient holding force. As an example, engagement structure 118 may be selected, shaped, and/or formed to deform wellbore tubular 60, to penetrate past a surface of wellbore tubular 60, to gall wellbore tubular 60, and/or to cold weld to wellbore tubular 60. As another example, engagement structure 118 may engage a baffle 68 that may be present within wellbore conduit 62.

In order to provide a desired degree of engagement with wellbore tubular 60 and thus a desired holding force for corrodible wellbore plug 100 within wellbore conduit 62, engagement structure 118 may be formed from a material that is different from a material of construction of slip ring 116. As an example, a hardness of engagement structure 118 may be greater than a hardness of slip ring 116. As more specific but still illustrative, non-exclusive examples, the hardness of engagement structure 118 may be at least 1.5, at least 2, at least 2.5, at least 3, at least 3.5, at least 4, at least 4.5, at least 5, at least 6, at least 7, at least 8, at least 9, at least 10, at least 11, at least 12, at least 13, at least 14, or at least 15 times greater than the hardness of slip ring 116.

It is within the scope of the present disclosure that engagement structure 118 may be formed from a material that resists corrosion by corrosive reservoir fluid 44 and/or that corrodes more slowly than corrodible metal 192 in corrosive reservoir fluid 44. However, it is also within the scope of the present disclosure that engagement structure 118 may be formed from a material that corrodes when in contact with corrosive reservoir fluid 44. More specific examples of materials that may comprise engagement structure 118 include iron, cast iron, anodized aluminum, carbide, and/or tungsten carbide.

As illustrated in dashed lines in FIGS. 2-3, corrodible wellbore plug 100 further may include a fluid conduit 186, a flow-control device 140 that regulates fluid flow within the fluid conduit, and/or a screening structure 170 that restricts flow of particulate material through flow-control device 140. As discussed, when corrodible wellbore plug 100 includes flow-control device 140, the corrodible wellbore plug also may be referred to herein as a corrodible frac plug 101.

Flow-control device 140 may be configured to permit fluid flow therethrough and past corrodible frac plug 101 in an uphole direction 72 (i.e., from downhole portion 66 to uphole portion 64) and to resist, or even block, fluid flow therethrough in a downhole direction 74 (i.e., from uphole portion 64 to downhole portion 66). Flow-control device 140 may include and/or be any suitable structure. As examples, flow-control device 140 may include a check valve 142 and/or a ball 144 and seat 146 assembly. Examples of fluid conduit 186 include any suitable opening, tube, and/or pipe. Examples of screening structure 170 include a screen that may form a portion of corrodible metallic portion 190.

As also illustrated in dashed lines in FIGS. 2-3, corrodible wellbore plug 100 further may include a sealing element 150. Sealing element 150 may be configured to form a fluid seal between corrodible wellbore plug 100 and wellbore tubular 60 when retention mechanism 110 is in retained conformation 114. Thus, sealing element 150 may resist fluid flow past corrodible wellbore plug 100 when the corrodible wellbore plug is retained within wellbore conduit 62.

When corrodible wellbore plug 100 includes sealing element 150 and flow-control device 140 (and associated fluid conduit 186), and when corrodible wellbore plug 100 is retained within wellbore conduit 62, the corrodible wellbore plug may resist, or even block, a majority, or even all, fluid flow from uphole portion 64 to downhole portion 66. However, the corrodible wellbore plug may permit fluid flow from downhole portion 66 to uphole portion 64 (via fluid conduit 186 and flow-control device 140).

When corrodible wellbore plug 100 includes sealing element 150 but does not include flow-control device 140 (and associated fluid conduit 186), and when corrodible wellbore plug 100 is retained within wellbore conduit 62, the corrodible wellbore plug may resist, or even block, a majority, or even all, fluid flow between uphole portion 64 and downhole portion 66.

Sealing element 150 may be formed from any suitable material. As examples, sealing element 150 may be formed from a polymer, a biodegradable polymer, a water-soluble polymer, a metal foil, an extrude-able compound, poly-lactic acid, and/or poly-glycolic acid.

It is within the scope of the present disclosure that sealing element 150 may degrade and/or dissolve upon contact with corrosive reservoir fluid 44. Additionally or alternatively, sealing element 150 also may be configured to break apart responsive to corrosion of corrodible metal 192.

As further illustrated in dashed lines in FIGS. 2-3, corrodible wellbore plug 100 also may include one or more reinforcing bodies 160. Reinforcing bodies 160 may be configured to reinforce, or increase a mechanical strength of, corrodible wellbore plug 100. As examples, reinforcing bodies 160 may be formed from a material that is more rigid than corrodible metal 192, may be formed from a material that does not corrode within corrosive reservoir fluid 44, and/or may be formed from a material that has a higher shear strength than that of corrodible metal 192.

Reinforcing bodies 160, when present, may be retained within corrodible wellbore plug 100 via corrodible metal 192. In addition, reinforcing bodies 160 may be shaped and/or sized such that the reinforcing bodies do not (significantly) restrict fluid flow within wellbore conduit 62 subsequent to corrosion (or complete corrosion) of corrodible metal 192. As examples, reinforcing bodies 160 may be shaped and/or sized to fall to a bottom of wellbore conduit 62 upon corrosion of corrodible metal 192, to fall within wellbore conduit 62 upon corrosion of corrodible metal 192, and/or to flow from wellbore conduit 62 during production of corrosive reservoir fluid 44 from the wellbore conduit.

As also illustrated in dashed lines in FIGS. 2-3, corrodible wellbore plug 100 may include one or more relief structures 180. Relief structures 180 may be located, shaped, and/or selected to increase a rate at which (and/or an extent to which) corrodible wellbore plug 100 breaks apart upon (complete) corrosion of corrodible metal 192. As an example, relief structures 180 may retain reinforcing bodies 160 within corrodible wellbore plug 100 and may be configured to facilitate separation of reinforcing bodies 160 from corrodible wellbore plug 100 upon corrosion of corrodible metal 192. Examples of relief structures 180 include any suitable relief angle, groove, channel, impression, surface etching, surface knurling, and/or high surface area region. Relief structures 180 may form a portion of any suitable component of corrodible wellbore plugs 100, and additional more specific examples of relief structures 180 are disclosed herein.

Figure 4:
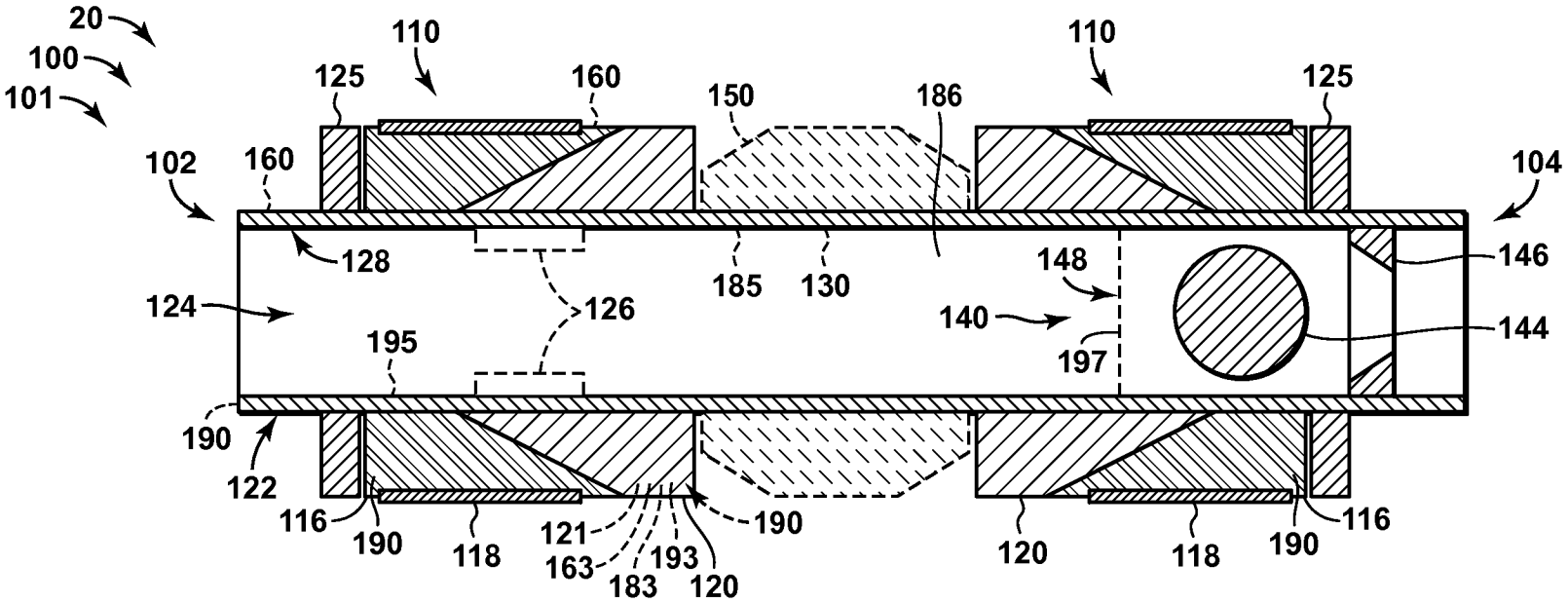
FIG. 4 is a less schematic cross-sectional view of a corrodible frac plug according to the present disclosure.

FIG. 4 is a less schematic cross-sectional view of a corrodible wellbore plug 100 in the form of a corrodible frac plug 101 according to the present disclosure. The corrodible frac plug of FIG. 4 includes a retention mechanism 110 that includes a plurality of cones 120, a mandrel 122, and a plurality of slip rings 116 that include respective engagement structures 118. Mandrel 122 is configured to press slip rings 116 against and/or over cones 120 to transition slip rings 116 from a retracted conformation to an expanded conformation. In the expanded conformation, engagement structures 118 operatively engage wellbore tubular 60 (as illustrated in FIG. 3), thereby retaining corrodible wellbore plug 100 within a wellbore conduit 62 (as illustrated in FIG. 3) that is defined by the wellbore tubular.

Cone 120 may include any suitable structure that is sized, shaped, and/or constructed to expand slip ring 116. As an example, cone 120 may have and/or define a hollow conical shape. As indicated in dashed lines in FIG. 4, cone 120 may form a portion of corrodible metallic portion 190 of corrodible wellbore plug 100. Thus, cone 120 may be formed from a corrodible cone material 193 that is selected to corrode upon contact with a corrosive reservoir fluid. Examples of the corrodible cone material are discussed herein with reference to corrodible metal 192.

As also indicated in dashed lines in FIG. 4, cone 120 may include one or more cone reinforcing bodies 163 and/or one or more cone relief structures 183. Thus, cone 120 may be configured to separate and/or break apart into a plurality of components, parts, and/or features (such as cone reinforcing bodies 163) upon (complete) corrosion of corrodible cone material 193. Cone reinforcing bodies 163 may be at least substantially similar to reinforcing bodies 160 that are discussed herein. Cone relief structures 183 may be at least substantially similar to relief structures 180 that are discussed herein.

As further indicated in dashed lines in FIG. 4, cone 120 also may include a cone surface area enhancing structure 121. Cone surface area enhancing structure 121 may be configured to increase a surface area of cone 120, thereby increasing a potential for, and/or a rate of, corrosion of corrodible cone material 193 upon contact between the corrodible cone material and the corrosive reservoir fluid.

Mandrel 122 may include any suitable structure that may be configured to be actuated to operatively press, force, and/or urge slip ring 116 onto and/or over cone 120 to transition the slip ring from the retracted conformation to the expanded conformation. As an example, mandrel 122 may include and/or be a tubular and/or a hollow cylindrical structure that defines a mandrel conduit 124. As another example, mandrel 122 may include end caps 125 that may be configured to press slip ring 116 over cone 120 upon actuation of the mandrel.

Mandrel 122 may be actuated in any suitable manner. As an example, the mandrel may be mechanically actuated. As a more specific example, end caps 125 may be threaded to a remainder of mandrel 122 and may be rotated relative to the remainder of mandrel 122 to draw the end caps toward one another and/or to press slip ring 116 over cone 120.

Mandrel 122 may be formed from any suitable material. As an example, mandrel 122 may form a portion of corrodible metallic portion 190 and may be formed from a corrodible mandrel material 195 that is selected to corrode responsive to contact with the corrosive reservoir fluid. Corrosion of mandrel 122 may permit other components of corrodible wellbore plug 100, such as cones 120 and/or slip rings 116, to separate from one another, thereby releasing the corrodible wellbore plug from operative engagement with the wellbore tubular.

When mandrel 122 includes corrodible mandrel material 195, the mandrel further may include a mandrel relief structure 185. Mandrel relief structure 185 may be configured to cause mandrel 122 to separate into a plurality of mandrel pieces responsive to corrosion of corrodible mandrel material 195. Examples of corrodible mandrel material 195 are discussed herein with reference to corrodible metal 192. Examples of mandrel relief structures 185 are discussed herein with reference to relief structures 180.

Mandrel conduit 124 may define, or be, fluid conduit 186 of FIGS. 1-3, and corrodible wellbore plug 100 further may include a corrosion-enhancing structure, such as a turbulence-generating structure 126, that extends within the mandrel conduit and/or that is configured to generate turbulence within fluid flow through the mandrel conduit. As an example, turbulence-generating structure 126 may include and/or be a projection that extends within the mandrel conduit. When mandrel 122 is formed from corrodible mandrel material 195, the turbulent flow may increase a corrosion rate of the mandrel when the corrosive reservoir fluid flows through the mandrel, such as by decreasing a boundary layer thickness and/or improving mass transfer between the mandrel and the corrosive reservoir fluid.

Additionally or alternatively, mandrel 122 may define an inner surface 128 that includes a mandrel surface area enhancing structure 130. Mandrel surface area enhancing structure 130 may be configured to increase a contact area between inner surface 128 and the corrosive reservoir fluid, thereby increasing a rate of corrosion of mandrel 122. Examples of mandrel surface area enhancing structures 130 include an etched surface, a roughened surface, and/or a knurled surface.

The surface area of inner surface 128 also may be increased by increasing the diameter of mandrel conduit 124. Thus, corrodible wellbore plugs 100 according to the present disclosure may include mandrel conduits 124 that have a larger diameter than mandrels of traditional wellbore plugs, with this increase in diameter increasing the surface area for corrosion of mandrel 122. When mandrel conduit 124 has a larger diameter, mandrel 122 also may have a decreased wall thickness, when compared to mandrels of traditional wellbore plugs, while maintaining a comparable overall tensile strength. This decreased wall thickness may decrease a time needed to corrode the mandrel, thereby increasing a rate at which corrodible wellbore plug 100 may corrode and/or break apart.

As illustrated in FIG. 4, corrodible wellbore plug 100 also may include a flow-control device 140. In the illustrated example, flow-control device 140 includes a ball 144 and seat 146, although other suitable structure may be utilized to selectively obstruct and permit fluid flow through fluid conduit 186. The flow-control device is configured to permit fluid flow through fluid conduit 186 from a downhole end 104 to an uphole end 102 of corrodible wellbore plug 100 but to restrict fluid flow from the uphole end to the downhole end. Flow-control device 140 further includes a ball retainer 148 that is configured to retain ball 144 proximal to seat 146. Ball retainer 148 may be a ball cage that may be formed from a corrodible cage material 197 that is selected to corrode upon contact with the corrosive reservoir fluid. Corrosion of corrodible cage material 197 may release ball 144 from corrodible wellbore plug 100, thereby decreasing a resistance to fluid flow through fluid conduit 186 and/or permitting fluid flow in both directions through the fluid conduit. Examples of corrodible cage material 197 are discussed herein with reference to corrodible metal 192, and it is within the scope of the present disclosure that ball 144 and/or seat 146 also may be formed from a corrodible material, such as corrodible metal 192.

As illustrated in dashed lines in FIG. 4, corrodible wellbore plug 100 also may include a sealing element 150. Sealing element 150 may be configured to form a fluid seal with the wellbore tubular when the corrodible wellbore plug is located within the wellbore conduit and transitioned to the retained conformation. Examples of sealing element 150 are disclosed herein.

Figure 5:
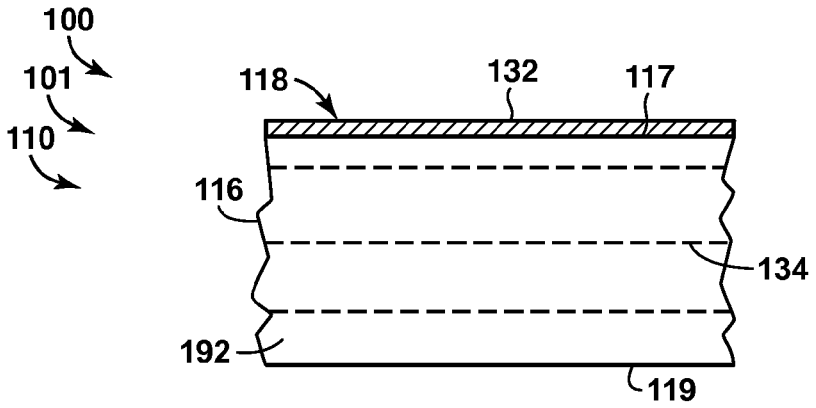
FIG. 5 is a fragmentary view of a schematic representation of an engagement structure that may form a portion of a retention mechanism according to the present disclosure.
Figure 6:
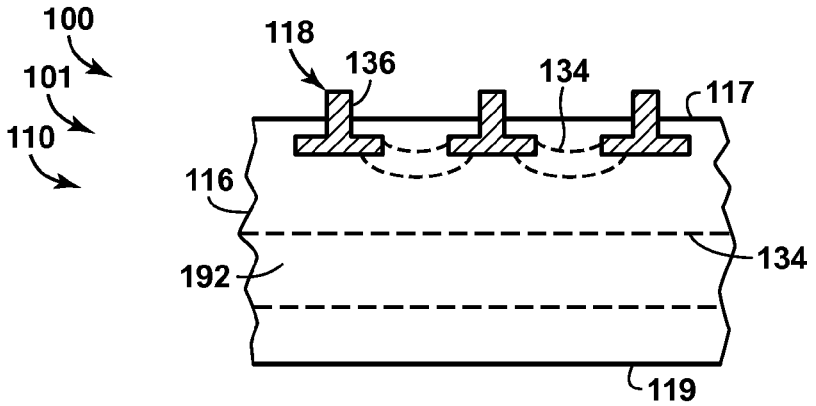
FIG. 6 is a fragmentary view of another schematic representation of an engagement structure that may form a portion of a retention mechanism according to the present disclosure.
Figure 7:
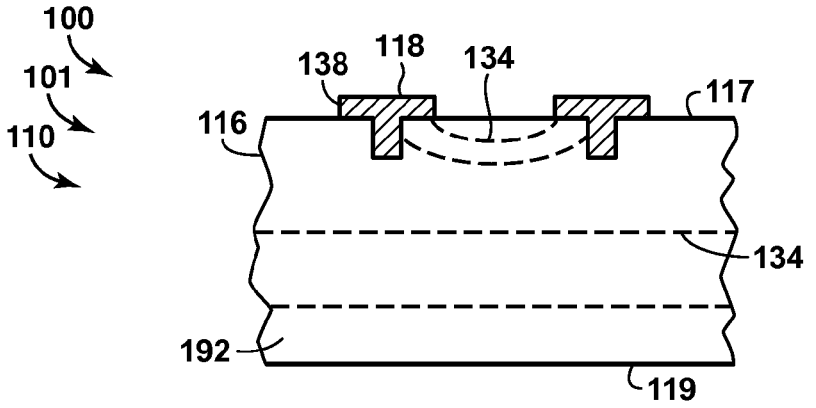
FIG. 7 is a fragmentary view of another schematic representation of an engagement structure that may form a portion of a retention mechanism according to the present disclosure.

FIGS. 5-7 provide schematic representations of examples of engagement structures 118 that may form a portion of retention mechanisms 110 according to the present disclosure. As illustrated in FIG. 5, engagement structure 118 may include a coating 132 that covers at least a portion of a peripheral surface 117 of slip ring 116. Under these conditions, and when slip ring 116 is formed from corrodible metal 192, slip ring 116 may progressively corrode from an inner surface 119 thereof to, or toward, peripheral surface 117, as indicated in dashed lines at 134. After a threshold amount of corrosion of slip ring 116 (or after the slip ring has corroded to at least a threshold extent), coating 132 may break apart.

As indicated in FIG. 6 at 136, engagement structures 118 may be embedded within slip ring 116 and may extend from peripheral surface 117. Under these conditions, slip ring 116 may progressively corrode from both peripheral surface 117 and inner surface 119, as indicated in dashed lines at 134. After a threshold amount of corrosion of slip ring 116 (or after the slip ring has corroded to at least a threshold extent), engagement structures 118 may be released from the slip ring.

As indicated in FIG. 7 at 138, engagement structures 118 may be operatively attached and/or affixed to slip ring 116 and may extend from peripheral surface 117. Under these conditions, slip ring 116 again may progressively corrode from both peripheral surface 117 and inner surface 119, as indicated in dashed lines at 134. After a threshold amount of corrosion of slip ring 116 (or after the slip ring has corroded to at least a threshold extent), engagement structures 118 may be released from the slip ring.

Figure 8:
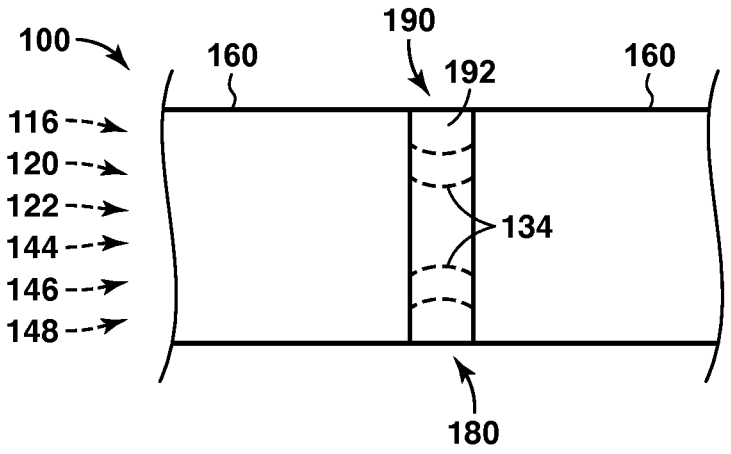
FIG. 8 is a fragmentary view of a schematic representation of a relief structure, according to the present disclosure, that is formed from a corrodible metallic portion and that operatively attaches two reinforcing bodies to one another.
Figure 9:
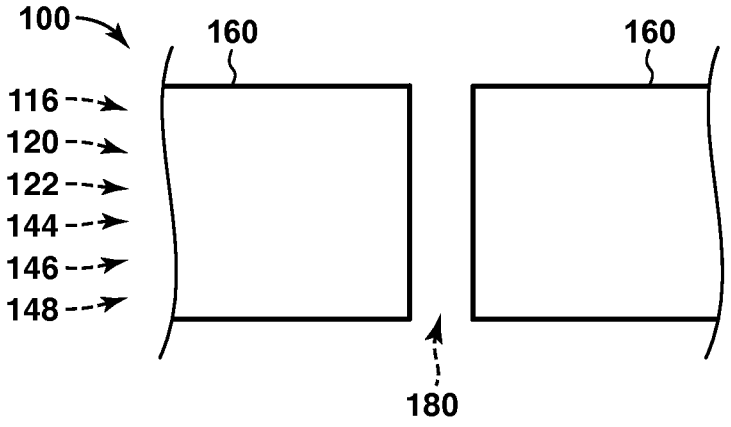
FIG. 9 is a fragmentary view of a schematic representation of the relief structure of FIG. 8 without the corrodible metallic portion.

FIGS. 8-9 are schematic representations of a relief structure 180, according to the present disclosure. Relief structure 180 is formed from a corrodible metal 192. As illustrated in FIG. 8, and prior to corrosion of corrodible metal 192, relief structure 180 operatively attaches two reinforcing bodies 160 to one another. Upon exposure of relief structure 180 to a corrosive reservoir fluid, corrodible metal 192 may corrode away, as indicated at 134. Subsequent to corrosion of corrodible metallic portion 190, and as illustrated in FIG. 9, reinforcing bodies 160 may be separated from one another, may be free to move relative to one another, and/or may no longer form a portion of (or be operatively attached to) corrodible wellbore plug 100. As discussed, relief structure 180 may form a portion of any suitable component of corrodible wellbore plug 100, such as slip ring 116, cone 120, mandrel 122, ball 144, seat 146, and/or ball retainer 148.

Figure 10:
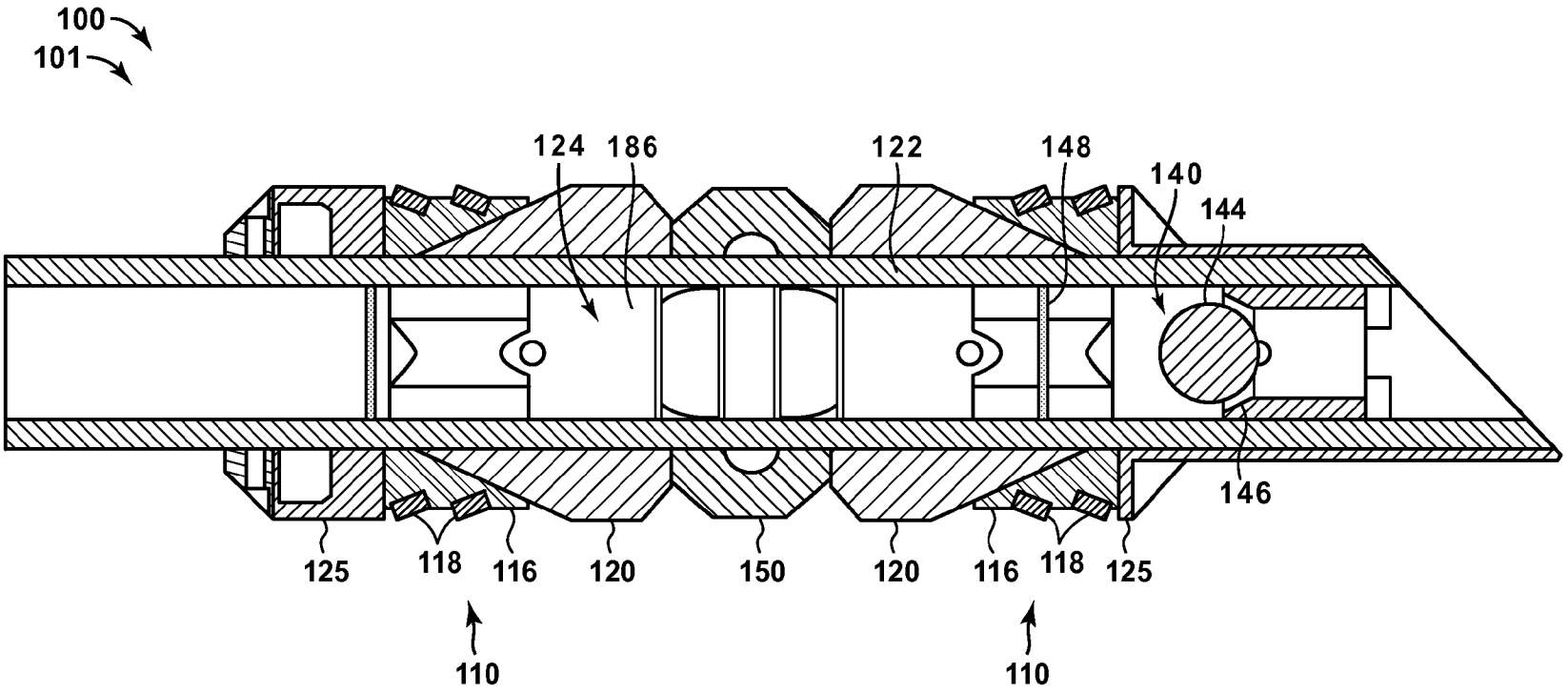
FIG. 10 is a less schematic cross-sectional view of a corrodible frac plug according to the present disclosure.
Figure 11:
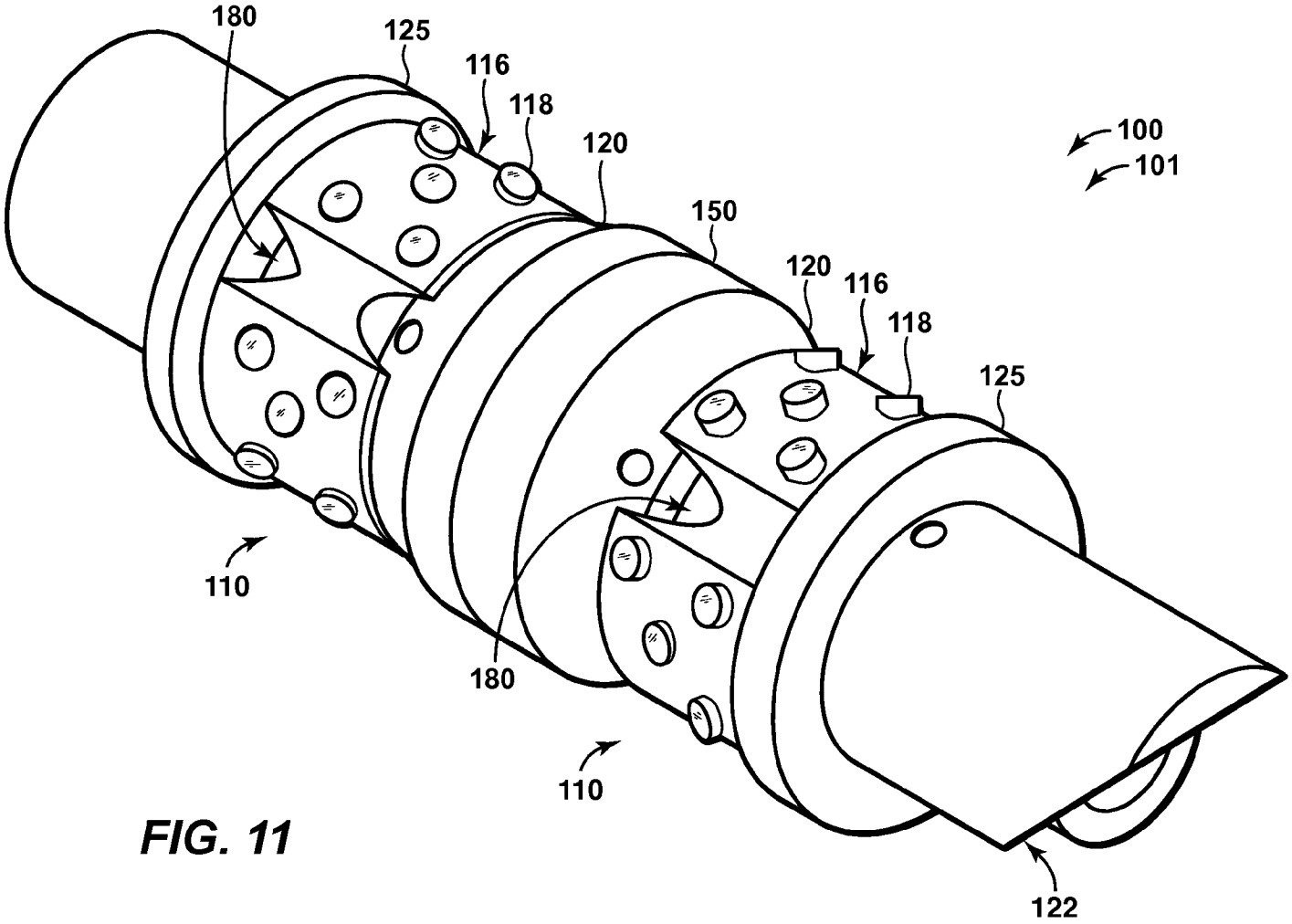
FIG. 11 is a less schematic profile view of the corrodible frac plug of FIG. 10.

FIG. 10 is a less schematic cross-sectional view of a corrodible wellbore plug 100 in the form of a corrodible frac plug 101 according to the present disclosure, while FIG. 11 is a less schematic profile view of corrodible frac plug 101 of FIG. 10. Corrodible frac plug 101 of FIGS. 10-11 includes a retention mechanism 110 in the form of two slip rings 116, two cones 120, and a mandrel 122. Corrodible frac plug 101 also includes a sealing element 150.

Mandrel 122 defines a mandrel conduit 124, which also may be referred to herein as a fluid conduit 186. Mandrel 122 further includes two end caps 125 that are configured to selectively urge slip rings 116 over cones 120 to expand the slip rings.

Retention mechanism 110 includes a plurality of engagement structures 118 that are operatively affixed to and/or embedded in slip ring 116. Slip rings 116 also include relief structures 180, as illustrated in FIG. 11.

As illustrated in FIG. 10, a flow-control device 140 is located within fluid conduit 186. Flow-control device 140 includes a ball 144, a seat 146, and a ball retainer 148.

Figure 12:
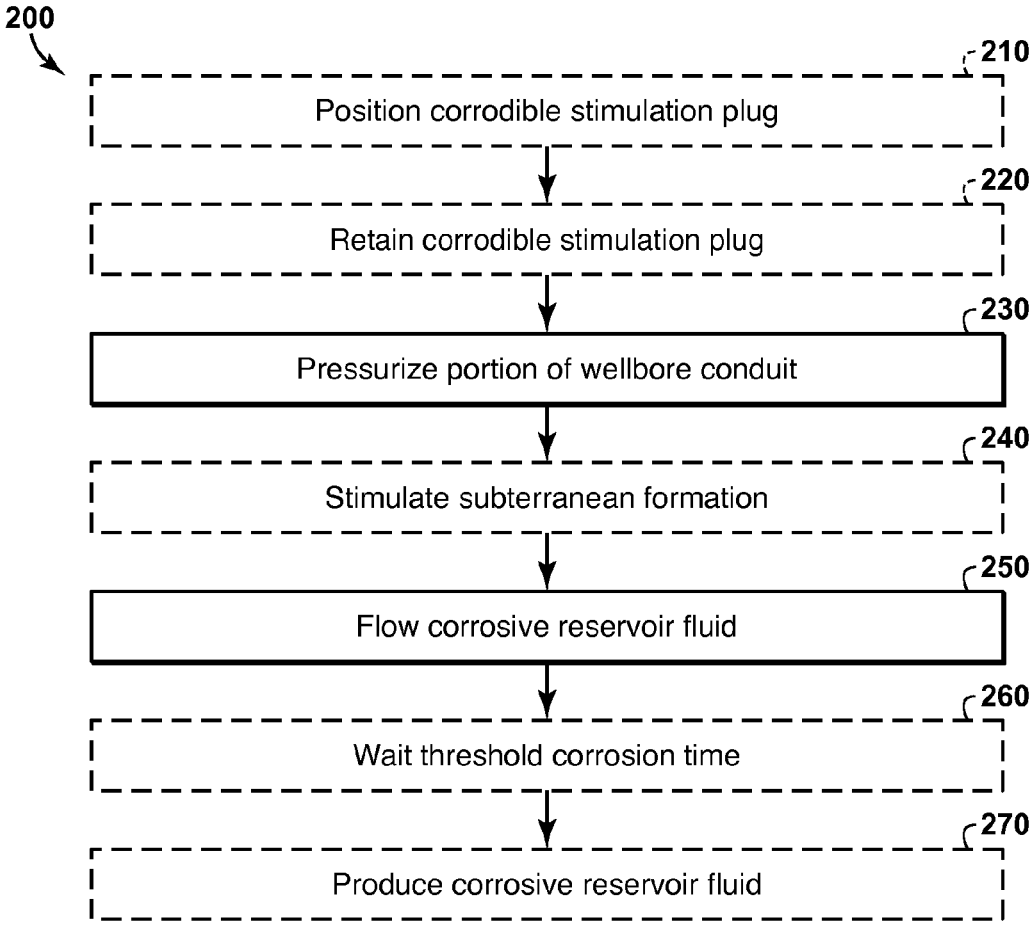
FIG. 12 is a flowchart depicting methods, according to the present disclosure, of completing a hydrocarbon well.

FIG. 12 is a flowchart depicting methods 200, according to the present disclosure, of completing a hydrocarbon well that extends within a subterranean formation. Methods 200 may include positioning a corrodible frac plug within a wellbore conduit at 210 and/or retaining the corrodible frac plug within the wellbore conduit at 220. Methods 200 include pressurizing a portion of the wellbore conduit that is uphole from the corrodible frac plug at 230 and may include stimulating the subterranean formation at 240. Methods 200 further include flowing a naturally occurring corrosive reservoir fluid from the subterranean formation at 250. Methods 200 may include waiting a threshold corrosion time at 260 and/or producing the corrosive reservoir fluid from the subterranean formation at 270.

Positioning the corrodible frac plug within the wellbore conduit at 210 may include locating and/or placing the corrodible frac plug within the wellbore conduit in any suitable manner. As an example, the positioning at 210 may include flowing the corrodible frac plug through the wellbore conduit and/or to a downhole location within the wellbore conduit. This may include flowing with, or within, a pressurizing fluid that may be utilized during the pressurizing at 230. When methods 200 include the positioning at 210, methods 200 further may include flowing the pressurizing fluid past the downhole location to purge and/or flush the wellbore conduit and/or to purge and/or flush the corrosive reservoir fluid from the wellbore conduit.

Retaining the corrodible frac plug within the wellbore conduit at 220 may include retaining the corrodible frac plug in any suitable manner. As an example, the retaining at 220 may include performing at least a portion of methods 300, which are discussed in more detail herein. As additional examples, the retaining at 220 also may include cold welding the corrodible frac plug to a wellbore tubular that defines the wellbore conduit and/or galling the wellbore tubular with the corrodible frac plug to retain, or immobilize, the corrodible frac plug within the wellbore conduit.

As yet another example, the retaining at 220 also may include expanding a slip ring of the corrodible frac plug to operatively engage the slip ring with the wellbore tubular. The slip ring may be at least partially, or even completely, formed from a corrodible metal and may be configured to corrode responsive to contact with the corrosive reservoir fluid. Alternatively, the slip ring may be at least partially, or even completely, formed from a material that has a greater resistance to corrosion by the corrosive reservoir fluid than the corrodible metal.

The retaining at 220 also may include operatively engaging an engagement structure of the slip ring with the wellbore tubular. When methods 200 include the retaining at 220, methods 200 further may include forming a fluid seal between the corrodible frac plug and the wellbore tubular with a sealing element. The fluid seal may be formed during, concurrently with, and/or responsive to the retaining at 220.

The sealing element may be configured, designed, and/or selected to corrode and/or break apart responsive to fluid contact with the corrosive reservoir fluid (or responsive to fluid contact between the corrodible frac plug and the corrosive reservoir fluid). Under these conditions, methods 200 further may include corroding the sealing element with the corrosive reservoir fluid responsive to contact between the sealing element and the corrosive reservoir fluid, dissolving the sealing element in the corrosive reservoir fluid responsive to contact between the sealing element and the corrosive reservoir fluid, and/or breaking apart the sealing element responsive to corrosion of the corrodible metal.

Pressurizing the portion of the wellbore conduit that is uphole from the corrodible frac plug at 230 may include pressurizing the portion of the wellbore conduit with a pressurizing fluid. The corrodible frac plug may include a flow-control device, and the flow-control device may be configured to permit fluid flow therethrough in an uphole direction and to restrict, limit, and/or block fluid flow therethrough in a downhole direction. Thus, methods 200 may include resisting fluid flow through the flow-control device in the downhole direction during the pressurizing, thereby permitting the pressurizing at 230.

The pressurizing at 230 may include providing the pressurizing fluid to the wellbore conduit, such as from a surface region. The pressurizing fluid that is in the wellbore and/or that is in fluid contact with the corrodible frac plug may have a temperature that is less than a threshold pressurizing fluid temperature. Additionally or alternatively, the pressurizing fluid that is in the wellbore and/or that is in fluid contact with the corrodible frac plug also may have a pH that is within a threshold pH range. Examples of the threshold temperature include threshold temperatures of less than 100 degrees Celsius, less than 90 degrees Celsius, less than 80 degrees Celsius, less than 70 degrees Celsius, less than 60 degrees Celsius, less than 50 degrees Celsius, less than 40 degrees Celsius, or less than 30 degrees Celsius. Examples of the threshold pH range include a pH of at least 4.0, at least 4.5, at least 5.0, at least 5.5, at least 6.0, or at least 6.5 and also less than 10.0, less than 9.5, less than 9.0, less than 8.5, less than 8.0, or less than 7.5.

The pressurizing at 230 further may include flushing the corrosive reservoir fluid from the wellbore conduit with the pressurizing fluid. Additionally or alternatively, methods 200 also may include resisting flow of the corrosive reservoir fluid into the wellbore conduit and/or into contact with the corrodible frac plug during the pressurizing at 230. This may prevent and/or decrease a potential for premature and/or undesired corrosion of the corrodible frac plug during the pressurizing at 230 and/or prior to the flowing at 250.

Stimulating the subterranean formation at 240 may include stimulating the subterranean formation in any suitable manner. As examples, the stimulating at 240 may include flowing the pressurizing fluid into the subterranean formation, pressurizing the subterranean formation with the pressurizing fluid, fracturing the subterranean formation with the pressurizing fluid, chemically treating the subterranean formation with the pressurizing fluid, and/or acid treating the subterranean formation with the pressurizing fluid.

As a more specific example, the stimulating at 240 may include perforating the wellbore tubular responsive to a pressure within the portion of the wellbore conduit that is uphole from the corrodible frac plug exceeding a threshold perforating pressure. The perforating may permit the pressurizing fluid to rapidly flow into the subterranean formation, thereby fracturing the subterranean formation.

It is within the scope of the present disclosure that the perforating may be repeated a plurality of times to create a plurality of perforations within the wellbore tubular and/or to stimulate and/or fracture a plurality of regions of the subterranean formation. As an example, the perforating may include creating a first perforation at a first location and fracturing the subterranean formation in the proximity of the first perforation. Subsequently, the first perforation may be sealed with a ball sealer, permitting the portion of the casing conduit that is uphole from the corrodible frac plug to be re-pressurized. A second perforation them may be created in the wellbore tubular at a second location that is uphole from the first perforation. The second perforation may be created responsive to the pressure within the portion of the wellbore conduit that is uphole form the corrodible frac plug once again exceeding the threshold perforating pressure, and the pressuring fluid may flow through the second perforation and into the subterranean formation, thereby fracturing a portion of the subterranean formation that is proximal to the second perforation.

Flowing the corrosive reservoir fluid from the subterranean formation at 250 may include flowing the corrosive reservoir fluid into the wellbore conduit and/or into contact with the corrodible frac plug. The corrodible frac plug may include a corrodible metallic portion that is formed from the corrodible metal, and the flowing at 250 may include flowing the corrosive reservoir fluid into (direct) fluid contact with the corrodible metal. As discussed herein, the corrodible metal may be selected to resist corrosion when in contact with the pressurizing fluid but to corrode responsive to contact with the corrosive reservoir fluid. Thus, the flowing at 250 may produce, initiate, and/or accelerate corrosion of the corrodible portion of the corrodible frac plug. The corrodible frac plug may be configured to be released from the downhole location and/or may be configured to be released from operative engagement with the wellbore tubular responsive to (partial and/or complete) corrosion of the corrodible metal.

As more specific examples, the flowing at 250 may include flowing the corrosive reservoir fluid through the flow-control device, flowing the corrosive reservoir fluid from the subterranean formation and into (direct fluid) contact with the corrodible frac plug, producing the corrosive reservoir fluid from the subterranean formation, producing the pressurizing fluid from the wellbore conduit, expelling the pressurizing fluid from the wellbore conduit, and/or decreasing a pressure within the subterranean formation. It is within the scope of the present disclosure that the corrodible frac plug may include a turbulence generating structure and/or that the flowing at 250 may include generating turbulent flow within the corrosive reservoir fluid and in contact with the corrodible frac plug. The turbulent flow may decrease mass transfer limitations and/or may accelerate corrosion of the corrodible metal.

The corrosive reservoir fluid may have any suitable temperature, pressure, pH, carbon dioxide content, and/or chloride content, and the flowing at 250 may include exposing the corrodible frac plug to the temperature, pressure, pH, carbon dioxide content, and/or chloride content of the corrosive reservoir fluid. Examples of the temperature, pressure, pH, carbon dioxide content, and/or chloride content of the corrosive reservoir fluid are disclosed herein.

As discussed in more detail herein, the flow-control device may include a check valve. Under these conditions, methods 200 may include corroding at least a portion of the check valve responsive to the flowing at 250. As a more specific example, the check valve may include a ball, a seat, and a ball retainer, and the ball, the seat, and/or the ball retainer may be formed from the corrodible metal. Under these conditions, methods 200 may include corroding the ball, the seat, and/or the ball retainer. When the ball retainer is formed from the corrodible metal, corrosion of the ball retainer may release the ball from the corrodible frac plug, thereby decreasing a resistance to fluid flow through the corrodible frac plug.

As also discussed in more detail herein, the corrodible frac plug may include a reinforcing material, and the reinforcing material may not (significantly or quickly) corrode within the corrosive reservoir fluid. The reinforcing material may define a plurality of reinforcing bodies that may define a portion of the corrodible frac plug. The plurality of reinforcing bodies may be retained within the corrodible frac plug by the corrodible metal. Corrosion of the corrodible metal may separate the plurality of reinforcing bodies from the corrodible frac plug, thereby causing the corrodible frac plug to break apart into a plurality of smaller components. The corrodible metal may form and/or define a relief structure that may be shaped to speed and/or facilitate separation of the plurality of reinforcing bodies.

Waiting the threshold corrosion time at 260 may include waiting any suitable threshold corrosion time for the corrodible frac plug to corrode and/or for the corrodible frac plug to be released from the wellbore conduit due to corrosion of the corrodible metal. Examples of the threshold corrosion time are disclosed herein.

It is within the scope of the present disclosure that the flowing at 250 may include continuously flowing the corrosive reservoir fluid during the waiting at 260. Additionally or alternatively, the flowing at 250 also may include intermittently flowing the corrosive reservoir fluid during the waiting at 260 and/or flowing the corrosive reservoir fluid prior to the waiting at 260.

Producing the corrosive reservoir fluid from the subterranean formation at 270 may include producing the corrosive reservoir fluid in any suitable manner and/or with any suitable sequence within methods 200. As an example, the producing at 270 may include producing subsequent to the pressurizing at 230. As additional examples, the producing at 270 also may include producing subsequent to the stimulating at 240, subsequent to the flowing at 250, concurrently with the flowing at 250, subsequent to the waiting at 260, and/or concurrently with the waiting at 260. It is within the scope of the present disclosure that the producing at 270 may include producing the corrosive reservoir fluid without drilling the corrodible frac plug out of the wellbore conduit.

Figure 13:
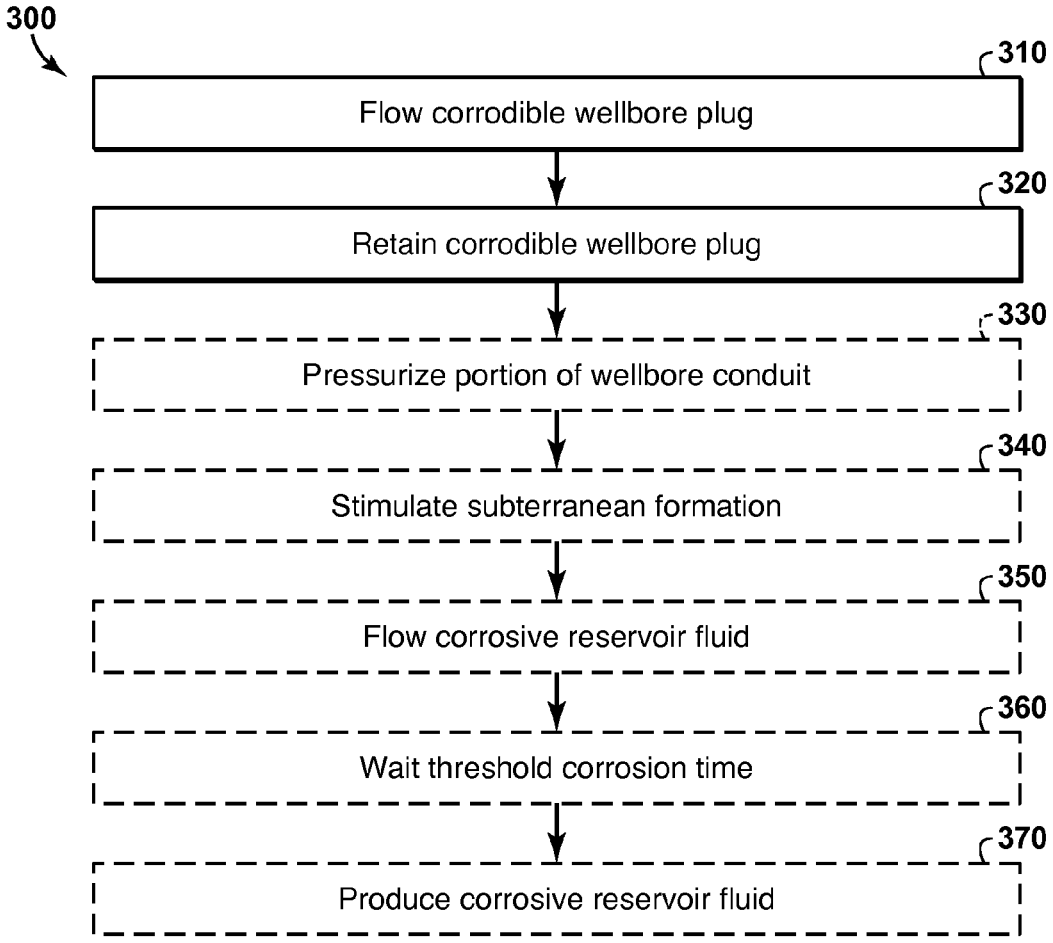
FIG. 13 is a flowchart depicting methods, according to the present disclosure, of retaining a corrodible wellbore plug within a wellbore conduit.

FIG. 13 is a flowchart depicting methods 300, according to the present disclosure, of retaining a corrodible wellbore plug within a wellbore conduit that is defined by a wellbore tubular that extends within a subterranean formation. The subterranean formation includes a naturally occurring corrosive reservoir fluid, and the corrodible wellbore plug 100 may be any of the corrodible wellbore plugs 100 disclosed and/or illustrated herein, including, but not limited to corrodible frac plugs 101 and corrodible bridge plugs. Methods 300 include flowing the corrodible wellbore plug to a downhole location within the wellbore conduit at 310 and retaining the corrodible wellbore plug at the downhole location at 320. Methods 300 further may include pressurizing a portion of the wellbore conduit that is uphole from the corrodible wellbore plug at 330, stimulating the subterranean formation at 340, flowing a naturally occurring corrosive reservoir fluid from the subterranean formation at 350, waiting a threshold corrosion time at 360, and/or producing the corrosive reservoir fluid from the subterranean formation at 370.

Flowing the corrodible wellbore plug to the downhole location within the wellbore conduit at 310 may include flowing and/or locating the corrodible wellbore plug at, or within, the downhole location in any suitable manner. As an example, the flowing at 310 may be at least substantially similar to the positioning at 210, which is discussed in more detail herein.

Retaining the corrodible wellbore plug at the downhole location at 320 may include retaining the corrodible wellbore plug in any suitable manner. As an example, the retaining at 320 may be at least substantially similar to the retaining at 220, which is discussed in more detail herein.

As another example, the corrodible wellbore plug may include a retention mechanism, and the retaining at 320 may include transitioning the retention mechanism from a mobile conformation, in which the corrodible wellbore plug is free to translate within the wellbore conduit, to a retained conformation, in which the corrodible wellbore plug operatively engages the wellbore tubular.

The retention mechanism may include a slip ring. The slip ring may be formed from a corrodible metal that is selected to corrode responsive to contact with the corrosive reservoir fluid. The slip ring may define a retracted conformation when the retention mechanism is in the mobile conformation and an expanded conformation when the retention mechanism is in the retained conformation.

The retention mechanism also may include an engagement structure. The engagement structure may be configured to operatively engage the wellbore tubular when the slip ring is in (or responsive to the slip ring transitioning to) the expanded conformation, and the retaining at 320 may include operatively engaging the engagement structure with the wellbore tubular.

The pressurizing at 330, the stimulating at 340, the flowing at 350, the waiting at 360, and/or the producing at 370 may be at least substantially similar to and/or may include any of the steps, components, and/or features that are described herein with reference to the pressurizing at 230, the stimulating at 240, the flowing at 250, the waiting at 260, and/or the producing at 270, respectively. However, it is noted that the wellbore plugs that may be utilized with methods 300 may, but are not required to, include the flow-control device of the corrodible frac plugs that may be utilized with methods 200.

As such, the pressurizing at 330 may, but is not required to, include the resisting that is described herein with reference to the pressurizing at 230. For example, the wellbore plug may resist fluid flow therepast in both directions, at least prior to the flowing at 350.

Similarly, the flowing at 350 may, but is not required to, include flowing through the flow-control device, as described herein with reference to the flowing at 250. For example, the corrosive reservoir fluid may flow into the wellbore conduit and/or into contact with the wellbore plug through perforations that are proximal to the wellbore plug, via naturally occurring subterranean flows, via diffusion, and/or via a combination of the above.

In the present disclosure, several of the examples have been discussed and/or presented in the context of flow diagrams, or flow charts, in which the methods are shown and described as a series of blocks, or steps. Unless specifically set forth in the accompanying description, the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer to A only (optionally including entities other than B); to B only (optionally including entities other than A); to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, to at least one, optionally including more than one, A, with no B present (and optionally including entities other than B); to at least one, optionally including more than one, B, with no A present (and optionally including entities other than A); to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the oil and gas industry.

The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are novel and non-obvious. Other combinations and subcombinations of features, functions, elements and/or properties may be claimed through amendment of the present claims or presentation of new claims in this or a related application. Such amended or new claims, whether different, broader, narrower, or equal in scope to the original claims, are also regarded as included within the subject matter of the present disclosure.

The invention claimed is:

1. A method of completing a hydrocarbon well that extends within a subterranean formation that contains a naturally occurring corrosive reservoir fluid, the method comprising:

pressurizing a portion of a wellbore conduit that is uphole from a corrodible frac plug with a pressurizing fluid, wherein the wellbore conduit is defined by a wellbore tubular that extends within the subterranean formation, and further wherein the corrodible frac plug is retained at a downhole location within the wellbore conduit and includes:

(i) a flow-control device that is configured to permit a fluid flow therethrough in an uphole direction and to restrict the fluid flow therethrough in a downhole direction; and (ii) a corrodible metallic portion that is formed from a corrodible metal that is selected to resist corrosion when in contact with the pressurizing fluid and to corrode responsive to contact with the corrosive reservoir fluid;

(iii) a reinforcing material that defines a plurality of reinforcing bodies that define a portion of the corrodible frac plug, wherein the reinforcing material does not corrode within the reservoir fluid, and wherein the corrodible metallic portion retains the plurality of reinforcing bodies within the corrodible frac plug; and subsequent to the pressurizing, flowing the corrosive reservoir fluid from the subterranean formation through the flow-control device, wherein the flowing includes contacting the corrodible frac plug with the corrosive reservoir fluid to corrode the corrodible metal to disengage the plurality of reinforcing bodies from the corrodible frac plug and release the corrodible frac plug from the downhole location within the wellbore conduit.

2. The method of claim 1, wherein the method further includes retaining the corrodible frac plug within the wellbore conduit.

3. The method of claim 2, wherein the retaining includes expanding a slip ring of the corrodible frac plug to operatively engage the slip ring with the wellbore tubular, wherein the slip ring is at least partially formed from the corrodible metal.

4. The method of claim 3, wherein the retaining includes operatively engaging an engagement structure of the slip ring with the wellbore tubular, wherein the engagement structure at least one of:

(i) is operatively attached to the slip ring;

(ii) is at least partially embedded within the slip ring; and (iii) coats a peripheral surface of the slip ring.

5. The method of claim 2, wherein the method further includes forming, with a sealing element, a fluid seal between the corrodible frac plug and the wellbore tubular during the retaining.

6. The method of claim 2, wherein the retaining includes at least one of:

(i) cold welding the corrodible frac plug to the wellbore tubular; and (ii) galling the wellbore tubular with the corrodible frac plug to retain the corrodible frac plug within the wellbore conduit.

7. The method of claim 1, wherein the method further includes stimulating the subterranean formation with the pressurizing fluid.

8. The method of claim 7, wherein the stimulating includes perforating the wellbore tubular responsive to a pressure within the portion of the wellbore conduit that is uphole from the corrodible frac plug exceeding a threshold perforating pressure.

9. The method of claim 8, wherein the perforating includes creating a first perforation within the wellbore tubular at a first location, wherein the method further includes sealing the first perforation with a ball sealer to re-pressurize the portion of the wellbore conduit that is uphole from the corrodible frac plug, and further wherein the method includes perforating the wellbore tubular to create a second perforation within the wellbore tubular at a second location that is uphole from the first location.

10. The method of claim 1, wherein the method further includes generating turbulent flow within the corrosive reservoir fluid and in contact with the corrodible frac plug to accelerate corrosion of the corrodible metal.

11. The method of claim 1, wherein the flowing the corrosive reservoir fluid includes heating the corrodible frac plug to a temperature of at least 100 degrees Celsius and exposing the corrodible frac plug to a pH of less than 4.5.

12. The method of claim 1, wherein the flowing the corrosive reservoir fluid includes contacting the corrosive reservoir fluid with the corrodible frac plug at a pressure of at least 5 megapascals.

13. The method of claim 1, wherein the corrosive reservoir fluid includes at least 1.0 mole percent carbon dioxide, and further wherein the flowing the corrosive reservoir fluid includes contacting the corrodible frac plug with the carbon dioxide.

14. The method of claim 1, wherein the corrodible metallic portion defines a relief structure that is shaped to facilitate the separating.

15. A corrodible frac plug configured to be retained within a wellbore conduit and to regulate a fluid flow within the wellbore conduit, wherein the wellbore conduit extends within a subterranean formation that includes a naturally occurring corrosive reservoir fluid, the corrodible frac plug comprising:

a plug body that is shaped to be placed within the wellbore conduit; and a retention mechanism that is configured to selectively transition between a mobile conformation, in which the corrodible frac plug is free to translate within the wellbore conduit, and a retained conformation wherein the corrodible frac plug operatively engages a wellbore tubular that defines the wellbore conduit to retain the corrodible frac plug at a downhole location within the wellbore conduit, the retention mechanism comprising:

(a) a slip ring that defines a retracted conformation when the retention mechanism is in the mobile conformation and an expanded conformation when the retention mechanism is in the retained conformation, wherein the slip ring is formed from a corrodible metal that is selected to corrode responsive to contact with the corrosive reservoir fluid;

(b) an engagement structure, wherein the engagement structure is configured to operatively engage the wellbore tubular when the slip ring is in the expanded conformation; and (c) a reinforcing material that defines a plurality of reinforcing bodies that define a portion of the corrodible frac plug, wherein the reinforcing material does not corrode within the reservoir fluid, and wherein the corrodible metal retains the plurality of reinforcing bodies within the corrodible frac plug.

16. The corrodible frac plug of claim 15, wherein the retention mechanism further includes a cone and a mandrel, wherein the mandrel is configured to press the slip ring against the cone to transition the slip ring from the retracted conformation to the expanded conformation.

17. The corrodible frac plug of claim 16, wherein at least one of:

(i) the cone is formed from a corrodible cone material that is selected to corrode responsive to contact with the corrosive reservoir fluid; and (ii) the mandrel is formed from a corrodible mandrel material that is selected to corrode responsive to contact with the corrosive reservoir fluid.

18. The corrodible frac plug of claim 16, wherein the mandrel is a hollow cylindrical mandrel that defines a mandrel conduit, and wherein the corrodible frac plug includes a turbulence-generating structure that is configured to generate turbulence within fluid flow through the mandrel conduit.

19. The corrodible frac plug of claim 15, wherein the corrodible frac plug further includes a flow-control device that is configured to permit fluid flow therethrough and past the corrodible frac plug in an uphole direction and to restrict fluid flow past the corrodible frac plug in a downhole direction when the corrodible frac plug is retained within the wellbore conduit.

20. The corrodible frac plug of claim 15, wherein the engagement structure is at least one of:

(i) operatively attached to the slip ring;

(ii) at least partially embedded within the slip ring;

(iii) a surface treatment that coats a peripheral surface of the slip ring;

(iv) a cladding that covers the peripheral surface of the slip ring; and (v) a surface texture that is defined by the slip ring.

21. The corrodible frac plug of claim 15, wherein a hardness of the engagement structure is at least 2 times greater than a hardness of the slip ring.

22. The corrodible frac plug of claim 15, wherein the corrodible frac plug further includes a sealing element that is configured to form a fluid seal between the corrodible frac plug and the wellbore tubular when the retention mechanism transitions to the retained conformation.

23. The corrodible frac plug of claim 15, wherein the corrodible frac plug further includes a reinforcing body that is configured to increase a mechanical strength of the corrodible frac plug, wherein the reinforcing body at least one of:

(i) is formed from a material that is more rigid than the corrodible metal;

(ii) is formed from a material that does not corrode within the corrosive reservoir fluid; and (iii) is formed from a material that has a higher shear strength than the corrodible metal.

24. The corrodible frac plug of claim 23, wherein the reinforcing body is sized to at least one of:

(i) fall to a bottom of the wellbore conduit upon corrosion of the corrodible metal;

(ii) fall within the wellbore conduit upon corrosion of the corrodible metal; and (iii) flow from the wellbore conduit during production of the corrosive reservoir fluid from the wellbore conduit.

25. A hydrocarbon well, comprising: a wellbore that extends within a subterranean formation; a wellbore tubular that extends within the wellbore and defines a wellbore conduit; a corrodible frac plug configured to be retained within a wellbore conduit and to regulate a fluid flow within the wellbore conduit, wherein the wellbore conduit extends within a subterranean formation that includes a naturally occurring corrosive reservoir fluid, the corrodible frac plug comprising;

a plug body that is shaped to be placed within the wellbore conduit; and a retention mechanism that is configured to selectively transition between a mobile conformation, in which the corrodible frac plug is free to translate within the wellbore conduit, and a retained conformation wherein the corrodible frac plug operatively engages a wellbore tubular that defines the wellbore conduit to retain the corrodible frac plug at a downhole location within the wellbore conduit, the retention mechanism comprising;

(a) a slip ring that defines a retracted conformation when the retention mechanism is in the mobile conformation and an expanded conformation when the retention mechanism is in the retained conformation, wherein the slip ring is formed from a corrodible metal that is selected to corrode responsive to contact with the corrosive reservoir fluid;

(b) an engagement structure, wherein the engagement structure is configured to operatively engage the wellbore tubular when the slip ring is in the expanded conformation;

(c) a reinforcing material that defines a plurality of reinforcing bodies that define a portion of the corrodible frac plug, wherein the reinforcing material does not corrode within the reservoir fluid, and wherein the corrodible metal retains the plurality of reinforcing bodies within the corrodible frac plug; and wherein the retention mechanism of the corrodible frac plug is in the retained conformation and the corrodible frac plug is retained within the wellbore conduit; and a corrosive reservoir fluid, wherein the corrosive reservoir fluid is in fluid contact with the corrodible metal of the corrodible frac plug, and further wherein at least a portion of the corrodible metal has been corroded by the corrosive reservoir fluid.

26. The hydrocarbon well of claim 25, wherein a temperature of the corrosive reservoir fluid that is in contact with the corrodible metal is at least 100 degrees Celsius, and further wherein a pH of the corrosive reservoir fluid that is in contact with the corrodible metal is less than 4.5.

27. The hydrocarbon well of claim 25, wherein a pressure of the corrosive reservoir fluid that is in contact with the corrodible metal is at least 5 megapascals.

28. The hydrocarbon well of claim 25, wherein the corrosive reservoir fluid that is in contact with the corrodible metal includes at least 1.0 mole percent carbon dioxide.

29. A method of retaining a corrodible wellbore plug within a wellbore conduit that is defined by a wellbore tubular, wherein the wellbore tubular extends within a subterranean formation that includes a naturally occurring corrosive reservoir fluid, the method comprising:

flowing the corrodible wellbore plug to a downhole location within the wellbore conduit; and retaining the corrodible wellbore plug at the downhole location, wherein the corrodible wellbore plug includes a retention mechanism and the retaining includes transitioning the retention mechanism from a mobile conformation, in which the corrodible wellbore plug is free to translate within the wellbore conduit, to a retained conformation, in which the corrodible wellbore plug operatively engages the wellbore tubular to resist motion of the corrodible wellbore plug within the wellbore tubular, wherein the retention mechanism includes:

(i) a slip ring that defines a retracted conformation when the retention mechanism is in the mobile conformation and an expanded conformation when the retention mechanism is in the retained conformation, wherein the slip ring is formed from a corrodible metal that is selected to corrode responsive to contact with the corrosive reservoir fluid;

(ii) an engagement structure that is configured to operatively engage the wellbore tubular when the slip ring is in the expanded conformation, wherein the retaining includes operatively engaging the engagement structure with the wellbore tubular; and (iii) a reinforcing material that defines a plurality of reinforcing bodies that define a portion of the corrodible frac plug, wherein the reinforcing material does not corrode within the reservoir fluid, and wherein the corrodible metal retains the plurality of reinforcing bodies within the corrodible frac plug.

* * * * *